US006571572B2

(12) United States Patent
Hobbs et al.

(10) Patent No.: US 6,571,572 B2
(45) Date of Patent: Jun. 3, 2003

(54) SINGLE PACKAGE WALL MOUNTED HVAC UNIT

(75) Inventors: Shelton P. Hobbs, Cordele, GA (US); Paul F. Fay, Cordele, GA (US)

(73) Assignee: Crispaire, a division of Airxcel, Inc., Cordele, GA (US)

( * ) Notice: Subject to any disclaimer, the term of this patent is extended or adjusted under 35 U.S.C. 154(b) by 0 days.

(21) Appl. No.: 10/123,720

(22) Filed: Apr. 16, 2002

(65) Prior Publication Data

US 2002/0184909 A1 Dec. 12, 2002

Related U.S. Application Data

(62) Division of application No. 09/363,282, filed on Jul. 28, 1999, now Pat. No. 6,370,899.

(51) Int. Cl.[7] ..... F25D 19/00; H01R 13/73

(52) U.S. Cl. ..... 62/298; 361/679; 439/545

(58) Field of Search ..... 62/298, 259.1; 361/679, 724, 725; 439/544, 545

(56) References Cited

U.S. PATENT DOCUMENTS

| | | | | |
|---|---|---|---|---|
| 3,871,188 A | 3/1975 | Vold et al. | ..... | 62/298 |
| 4,733,543 A | 3/1988 | Blair | ..... | 62/263 |
| 4,854,376 A | 8/1989 | Tunekawa et al. | ..... | 62/263 |
| 4,958,550 A | 9/1990 | Kuroda et al. | ..... | 62/263 |
| 5,140,830 A | 8/1992 | Sawyer | ..... | 62/298 |
| 5,444,990 A | 8/1995 | McGill, III et al. | ..... | 62/298 |
| 6,370,899 B1 | 4/2002 | Hobbs et al. | ..... | 62/259.1 |

*Primary Examiner*—Chen Wen Jiang
(74) *Attorney, Agent, or Firm*—Shook, Hardy & Bacon L.L.P.

(57) ABSTRACT

A single package wall mounted HVAC unit comprising a cabinet assembly including a primary cabinet subassembly, a back panel subassembly adapted to close the open back of the back panel subassembly, and cabinet connection means for removably attaching the primary cabinet subassembly to the back panel subassembly so that the back panel subassembly can be attached to the wall of a structure and then the primary cabinet subassembly can be positioned on and attached to the back panel subassembly. Also disclosed is a blower mounting arrangement for selectively mounting the air circulation blower within the cabinet subassembly in different positions to attenuate the blower noise transmitted to the conditioned space. An interlock is disclosed for the control box to prevent the control box cover from being removed without disconnecting the HVAC unit from the power supply. The outdoor coil assembly is arranged diagonally across the outdoor chamber in the cabinet assembly and the outdoor fan assembly is mounted directly on the cabinet panel covering the front of the outdoor chamber.

2 Claims, 15 Drawing Sheets

10
36
20
135
31
23
136
38
74
75
11
24
A1
21
28
22
34
80
81
175
176
P4
P3
70
78
76
23

10
36
11
71
209
31
HT1
21
72
38
12
15
20
32
34
80
82
208
135
202
136
250

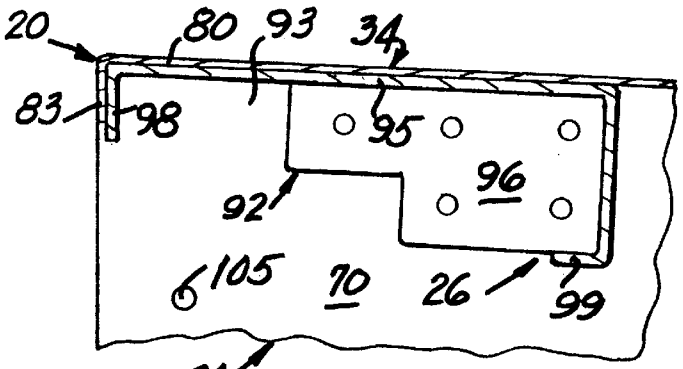
FIG 14
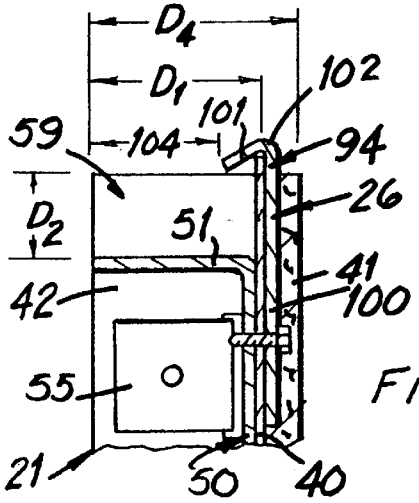
FIG 13
FIG. 3
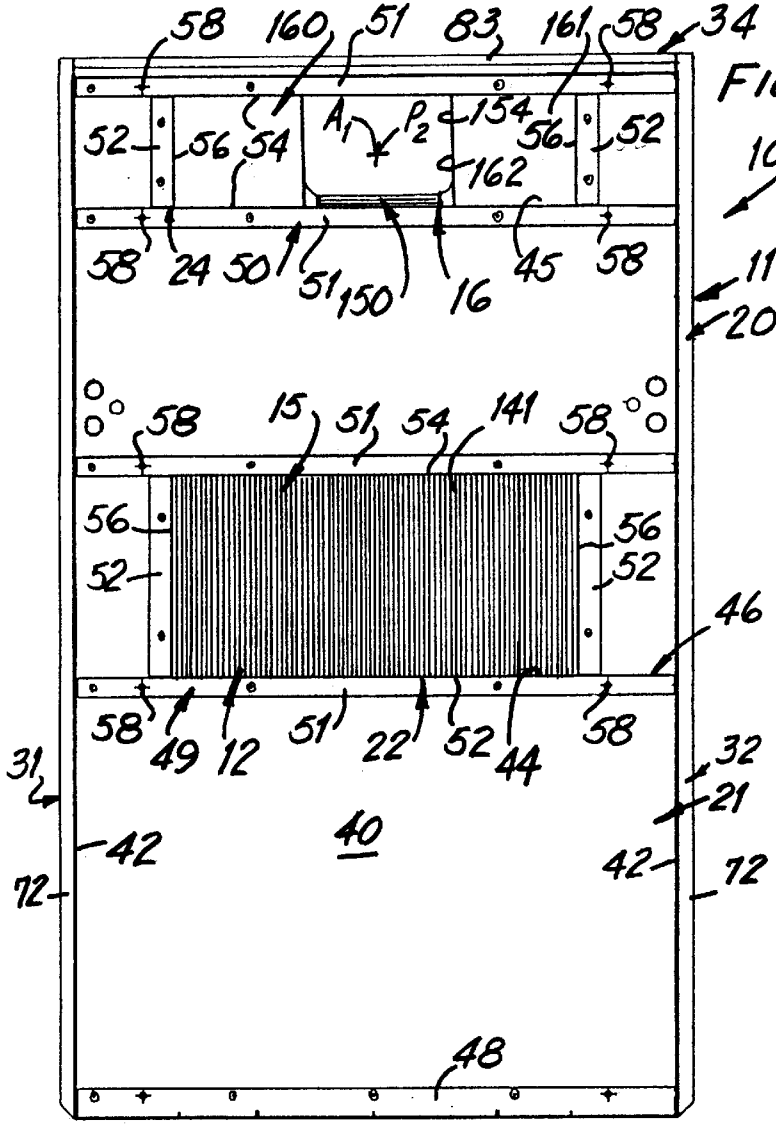

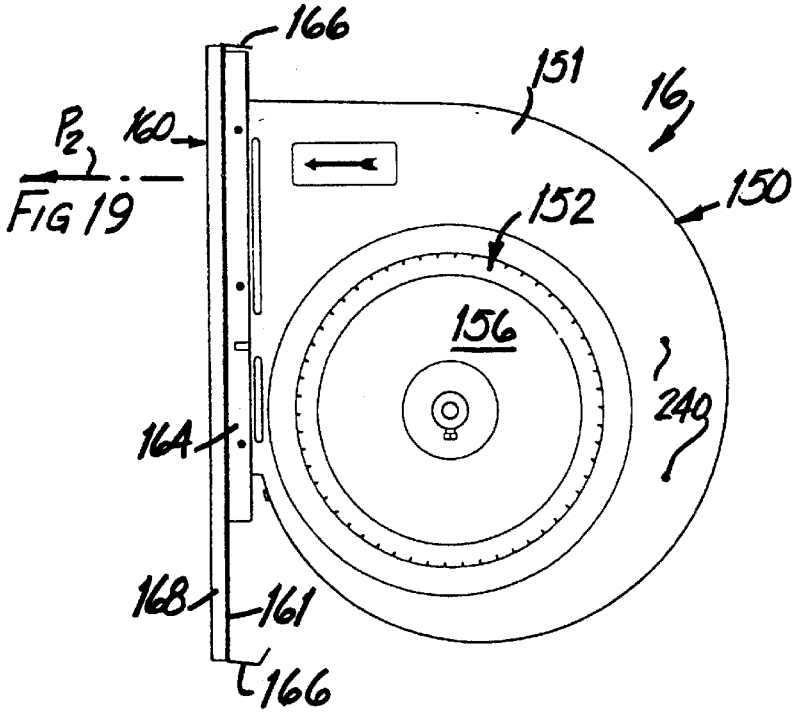
FIG 19
FIG 20
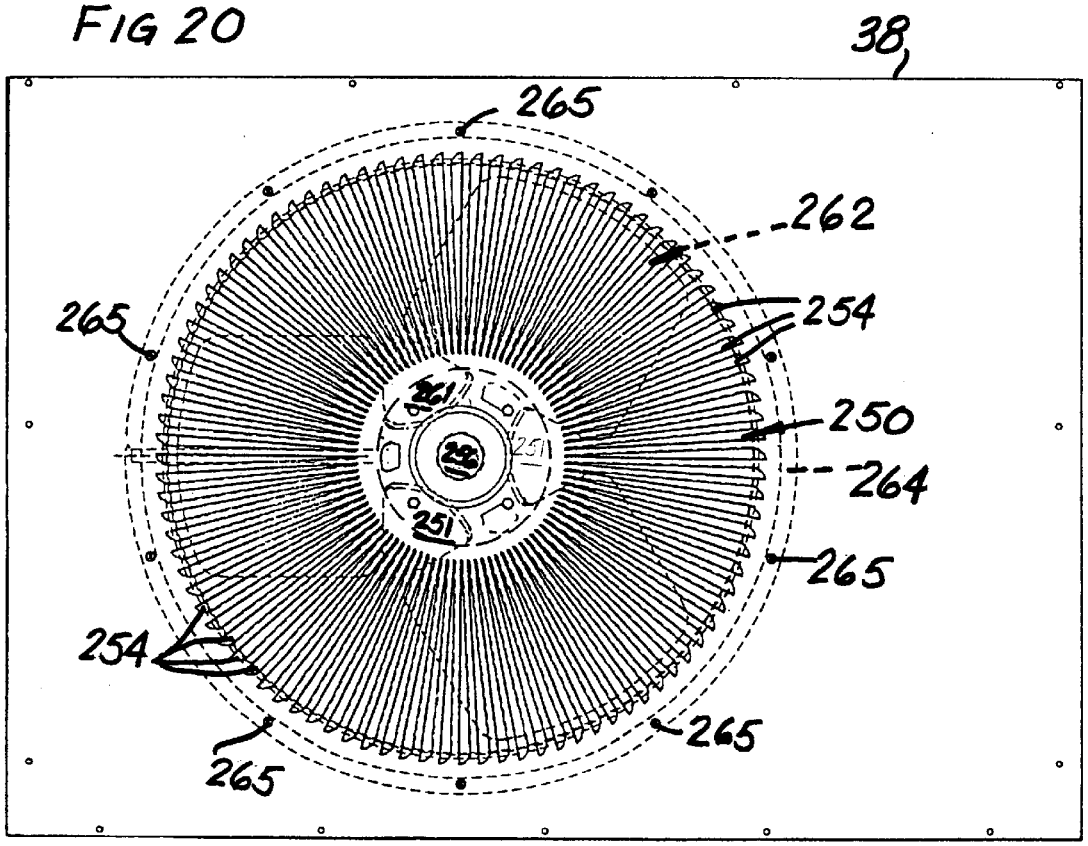

10
11
20
21
31
32
36
38
40
70
71
72
91
92
94
95
100
102
135
136
181
182
185
188
192
202
205
206
208
250

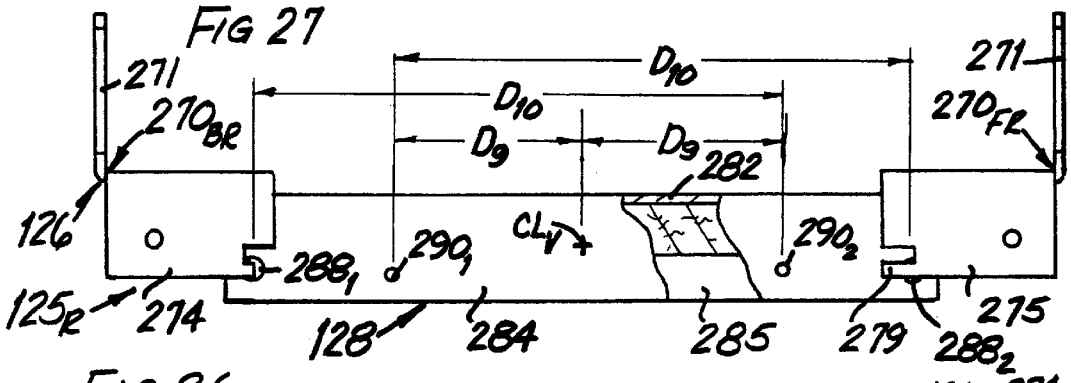
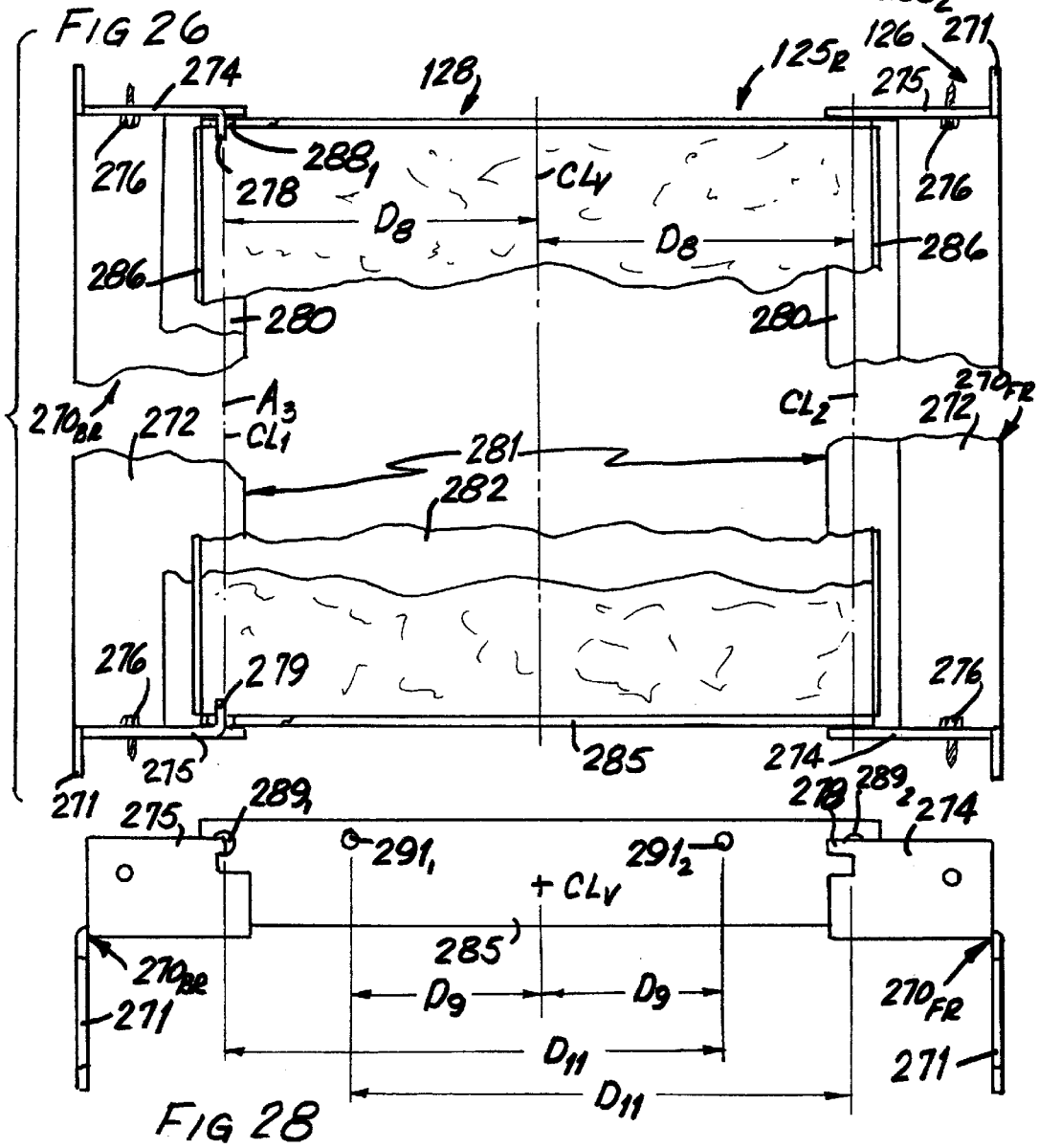
FIG 28

SINGLE PACKAGE WALL MOUNTED HVAC UNIT

This application is a divisional of U.S. patent application Ser. No. 09/363,282, filed on Jul. 28, 1999, which issued as U.S. Pat. No. 6,370,899 on Apr. 16, 2002.

BACKGROUND OF THE INVENTION

This invention relates generally to heating, ventilating and air conditioning (HVAC) equipment and more particularly to single package HVAC equipment adapted to be mounted on the wall of a structure to condition the air in an enclosed space within the structure.

Single package wall mounted HVAC equipment is well known. Cost, serviceability, safety, and reliability are several factors that contribute to successful wall mounted HVAC units. Manufacturing cost and installation cost contribute to the overall cost of the equipment. Moreover, noise generated in the air supply from the HVAC units is limited by application and governmental regulations.

In the past, wall mounted HVAC units have been made with a preassembled cabinet which must be maintained intact during installation to prevent damage to the unit. This has necessitated supporting and positioning of the unit against the wall of the structure while at the same time attempting to insure that the air return and air supply duct flanges on the back of the cabinet align with the air return and air supply passages through the wall. Because the workmen could not see the duct flanges sufficiently while supporting the unit in position against the wall and because of the weight of the unit required auxiliary lift equipment to support the unit while it was being positioned on the wall, these prior art units were frequently installed with the duct flanges improperly aligned with the air return and supply passages through the wall. This has resulted in damaging the duct flanges so as to leave cracks at the wall/duct flange interface. These cracks allowed dust and small debris from the wall structure to enter the air passage through the unit and also allow air being forced out the air supply passage in the unit to escape. Moreover, the wall structure behind the cracks was exposed directly to the radiant heat from the electric resistance heater just inside the air supply duct flange. Since both the debris and wall structure were exposed to the high temperature from the heater, the heaters in these prior art units sometimes caused fires. Moreover, the efficiency of the unit was frequently reduced due to this air leakage through the cracks around the damaged duct flanges. Because the entire weight of these prior art units had to be supported by the auxiliary lift devices while the unit was positioned on the structure, the likelihood of injury and the cost of installation has been relatively high.

Some prior art wall mounted HVAC units have attempted to move the electric resistance heater away from close proximity to the air supply outlet so as to reduce the likelihood of fire from the heater. As a result, the air circulation blower was moved downstream of the indoor refrigerant coil and the heater was moved upstream of the air circulation blower. While the positioning of the heater reduced the likelihood of fires, the air circulation blowers discharged directly out of the air supply opening from the unit producing an unacceptably high noise level when no noise attenuation duct structure was located downstream of the air circulation blower. Moreover, when the air circulation blower was moved downstream of the indoor refrigerant coil, fresh air was typically introduced into the circulating air stream to the space being conditioned downstream of the indoor refrigerant coil also. This has resulted in making it more difficult to accurately control the temperature in the conditioned air being supplied back to the enclosed space.

Prior art single package wall mounted HVAC units have typically located the control box within the cabinet assembly so that the front service panel had to be removed while the service personnel gained access to the electrical and refrigerant check points in the control box for servicing the unit. This has made it difficult for the unit to be operated in the manner necessary for accurate servicing by the service personnel because the air passage through the unit had to be left open to the outside air. As a result it was difficult to accurately service the unit.

Prior art single package wall mounted HVAC units frequently have power disconnect devices that allow the power to be disconnected from the electrical components of the unit. However, these prior art units were constructed so that the disconnect devices did not have to disconnect power from the electrical components before the control box cover was removed. As a result, removal of the control box cover while power was still supplied the electrical components increased the danger of shock and damage to the electrical components of the unit.

These prior art single package HVAC units were typically manufactured with the back panel first attached to at least one of the side panels. In order to install the system components, it was necessary to temporarily support the other side of the various divider plates and other support structure eventually supported by the other side panel. This has not only made manufacturing tolerances difficult to maintain in order to insure proper cabinet alignment and also made access to the various components within the cabinet for electrical and refrigerant connections more difficult due to the presence of the back panel early in the manufacturing process.

Examples of prior art HVAC unit constructions are illustrated in the following prior art patents:

| U.S. Pat. No. | Inventor | Issue Date |
|---|---|---|
| 3,871,188 | Vold, et al. | March, 1975 |
| 4,733,543 | Blair | March, 1988 |
| 5,140,830 | Sawyer | August, 1992 |
| 5,301,744 | Derks | April, 1994 |
| 5,444,990 | McGill, et al. | August, 1995 |

SUMMARY OF THE INVENTION

These and other problems and disadvantages associated with the prior art are overcome by the invention disclosed herein by providing a single package HVAC unit which can be easily mounted on the wall of the structure, which is easily serviced, inexpensive to manufacture and install, and which is safe to operate and maintain. The single package HVAC unit incorporating the invention has a first lightweight cabinet subassembly that can be mounted on the wall of a structure so that the air return and air supply duct flanges on the first cabinet subassembly can be easily visually aligned with the air return and air supply openings through the wall and a second heavier cabinet subassembly mounting all of the mechanical and electrical components of the unit that is installed on the first cabinet subassembly after it is installed on the wall. A hook means is provided that permits the second cabinet subassembly to engage the first cabinet subassembly in an initial tilted position and then pivot on the first cabinet subassembly to the final position overlying the first cabinet subassembly to facilitate alignment between the cabinet subassemblies during installation. The hook means may be at the top of the cabinet subassemblies so that the weight of the second cabinet subassembly causes it to pivot toward the final overlying position on the first cabinet subassembly. The invention further includes a blower assembly repositionable in the air circulation passage through the cabinet assembly so as to attenuate the noise transmitted to the space in the structure being conditioned yet maintain the required volumetric air supply output from the HVAC unit. The cabinet assembly is sized so that the blower assembly can discharge air into the air circulation passage downstream of the indoor refrigerant coil and out of alignment with the air supply outlet from the HVAC unit. The invention also includes a heater means repositionable within the air circulation passage through the cabinet assembly so as to maintain the desired orientation of the heater means to meet the operational design of the heater means. The invention includes a fresh air damper construction located in the vicinity of the air return opening into the HVAC unit and immediately downstream of the indoor refrigerant coil so that fresh air is induced into the air stream passing through the HVAC unit downstream of the indoor refrigerant coil. Likewise, the invention includes a safety interconnect means between the control box cover and the electrical disconnect in the control box to prevent removal of the control box cover without disconnecting the electrical controls in the HVAC unit from the power source. The invention also includes using a straight outdoor coil oriented diagonally of the outdoor chamber in the single package HVAC unit to minimize manufacturing cost and maximize air flow uniformity through the outdoor coil.

The invention is incorporated in a single package HVAC unit adapted to be mounted on a structure over the air return and air supply passages through the structure wall and condition the air for an interior space in the structure comprising conditioning means for conditioning the air for the interior space and a cabinet assembly housing said conditioning means including a first cabinet subassembly adapted to be attached to the wall of the structure with air return and air supply duct flanges projecting into the air return and air supply passages, a second cabinet subassembly adapted to be removably mounted on the first cabinet subassembly, and prepositioning means adapted to preposition the second cabinet subassembly with respect to the first cabinet subassembly and support the second cabinet subassembly on the first cabinet subassembly while the second cabinet assembly is moved from an initial tilted position into a final seated position in registration with the first cabinet subassembly. The prepositioning means may comprise first hook means mounted on the first cabinet subassembly and second hook means mounted on the second cabinet subassembly where the first and second hook means are constructed and arranged for the second hook means to engage the first hook means and support the second cabinet subassembly on the first cabinet subassembly. The first and second hook means may be constructed and arranged so that the second hook means can slide on the first hook means for a limited distance so that the second cabinet subassembly can be slipped into the final seated position in registration with the first cabinet subassembly and may be mounted at the top of the first and second cabinet subassemblies so that the weight of the HVAC unit causes the second cabinet subassembly to pivot toward the final seated position when the second hook means supports the second cabinet subassembly on the first hook means.

The invention may further include air circulation blower means for discharging air therefrom along a prescribed air discharge path and blower mounting means adapted to selectively mount the blower means in a first blower discharge position in the cabinet assembly with the air discharge path is generally axially aligned with the axis of the air supply outlet from the HVAC unit and a second blower discharge position so that the air discharge path is out of alignment with the axis of the air supply outlet to reduce the noise level transmitted out of the air supply outlet. The blower mounting means may include a blower mounting plate corresponding in size and shape to the cross-sectional size and shape of said air circulation passage through the cabinet assembly and fixedly mounting the blower means thereon with the blower intake opening on one side thereof and the blower discharge opening on the other side thereof, and blower plate mounting means for selectively mounting the blower mounting plate in the cabinet assembly within the air circulation passage in the first discharge position so that the blower plate is adjacent the air supply outlet and the discharge outlet opening on the blower means is axially aligned with the air supply outlet, and alternatively in the second position so that the blower plate is spaced away from the air supply outlet and the discharge outlet opening on the blower means is out of alignment with the air supply outlet and a plenum space is defined in the air circulation passage downstream of the blower mounting plate into which the air is discharged from the blower means to reduce the noise transmitted out of the air supply opening. The heater mounting means may selectively mount the heater means adjacent the air intake opening so that air passes into the blower air intake opening through the heater means to be selectively heated in a first orientation relative to the blower means when the blower means is located in the first blower discharge position and in a second orientation relative to the blower means when the blower means is in the second discharge position. The heater means may include a temperature responsive limit switch means located at a prescribed position within the heater means, and the heater mounting means may movably mount the heater means adjacent the air intake opening so that the temperature responsive limit switch means is positioned in the uppermost portion of the heater means relative to the horizontal when the blower means is positioned in the first discharge position and the second discharge position.

The apparatus of the invention may also include the indoor coil of the refrigeration circuit being generally vertically oriented and aligned with the air return opening in the cabinet assembly, a fresh air damper subchamber forming assembly positioned in the cabinet assembly between the inlet side of the indoor coil and the air return opening to define a fresh air damper subchamber sealed to the air return opening at one end thereof and to the indoor coil at the opposite end thereof so that air returning through the air return opening in the cabinet assembly passes through the fresh air damper subchamber to the indoor coil where the fresh air damper subchamber extends between opposite sides of the cabinet assembly and the cabinet assembly defines at least one fresh air inlet opening therethrough in communication with the fresh air damper subchamber; and, a fresh air damper assembly mounted in the fresh air damper subchamber adjacent the fresh air inlet opening for controlling the amount of outside air drawn into the fresh air damper subchamber through the fresh air inlet opening upstream of the indoor coil. The fresh air damper assembly may comprise a damper frame assembly mounted in the fresh air damper subchamber and defining a fresh air damper opening therethrough, a damper door pivotally mounted on the damper frame assembly and adapted to selectively close the fresh air opening through the damper frame assembly, and damper positioning means for selectively maintaining the damper door in a plurality of pivotal positions relative to the fresh air damper opening so as to control the amount of fresh air induced into the air from the space to be conditioned passing through the fresh air damper subchamber.

The apparatus of the invention may likewise include disconnect means mounted in an open front control box in the cabinet assembly with a base element in the control box and a connecting element that removably insertable into the base element to connect the electrical controls for the unit to a power source, a control box cover removably covering the open front of the control box, and interconnect means on the control box cover operatively engaging the disconnect means so as to prevent removal of the control box cover from the control box without removal of the connecting element from the base element of the disconnect means. The interconnect means may include an insertable body on the connecting element with a projecting flange and a disconnect cover member constructed and arranged to overlie the base element with an opening allowing the insertable body to pass therethrough but not the flange on the insertable body.

The apparatus of the invention may also include a front service panel sized to cover the front access opening in the cabinet assembly, a control box assembly along one side of the front access opening with the interior thereof sealed with respect to the air circulation passage through the cabinet assembly, and front service panel attachment means for selectively attaching the front service panel to the cabinet assembly in a first sealing position so that the front service panel closes the front access opening and the control box assembly, and in a second sealing position so that the front service panel closes the front access opening while leaving the control box assembly uncovered whereby the interior of the control box assembly is accessible from outside the cabinet assembly for service while the air circulation passage remains sealed to allow the HVAC unit to operate as designed during servicing. The control box assembly may include an open front control box defining a sealing lip thereon extending across the access opening and coplanar with the periphery of the access opening and the front panel attachment means may include a first set of holes in the front access panel, a second set of holes in the cabinet assembly in registration with the first set of holes when the access panel is in the first sealing position, a third set of holes in the cabinet assembly in registration with the first set of holes in the access panel when the access panel is in the second sealing position.

The apparatus of the invention may also include a straight outdoor coil assembly mounted in the outdoor chamber of the cabinet assembly and extending diagonally across the outdoor chamber where inlet openings through the side and bottom of the cabinet assembly supply outdoor air to one side of the coil assembly and a discharge opening in the front of the cabinet assembly provides a discharge of air from the opposite side of the coil assembly, and an outdoor air circulation means for moving the air through the outdoor coil assembly. The refrigerant compressor may be mounted in the outdoor compartment downstream of the outdoor coil assembly. The cabinet may define an outdoor chamber access opening to the front of the outdoor chamber with the outdoor air circulation means including an outdoor air fan mounting panel removably mounted on the cabinet assembly to close the front of the outdoor chamber and defining the front outdoor air discharge opening from the outdoor chamber therethrough, and an outdoor air fan assembly directly mounted on the outdoor air fan mounting panel and overlying the front outdoor air discharge opening to draw outdoor air through the outdoor coil assembly and force the outdoor air out of the outdoor air chamber through the front outdoor air discharge opening. The outdoor air circulation means may further include a spun single piece venturi member attached directly to the outdoor air fan mounting panel around the front opening to form a venturi around the outdoor air fan assembly and stiffen the outdoor air fan mounting panel.

These and other features and advantages of the invention will become more clearly understood upon consideration of the following detailed description and accompanying drawings wherein like characters of reference designate corresponding parts throughout the several views and in which:

BRIEF DESCRIPTION OF THE DRAWINGS

FIG. 3 is a rear view of the invention;

FIG. 13 is an enlarged cross-sectional view showing the construction of the hook means on the upper end of the back panel subassembly;

FIG. 14 is an enlarged cross-sectional view showing the construction of the hook means on the upper end of the primary cabinet subassembly;

FIG. 19 is an enlarged side view of the indoor blower means and blower mounting means;

FIG. 20 is an enlarged front view of the outdoor fan means and outdoor fan mounting panel;

FIG. 26 is an enlarged elevational view of the damper assembly of the invention;

FIG. 27 is an enlarged top view of the damper assembly of the invention; and FIG. 28 is an enlarged bottom view of the damper assembly of the invention.

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Figure 2:
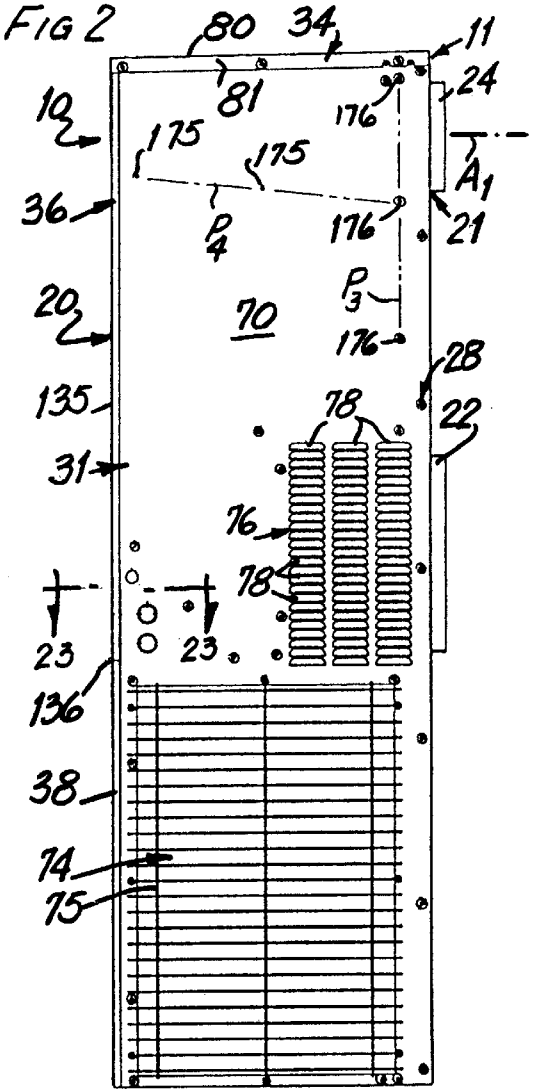
FIG. 2 is a right side view of the invention seen in FIG. 1.
Figure 1:
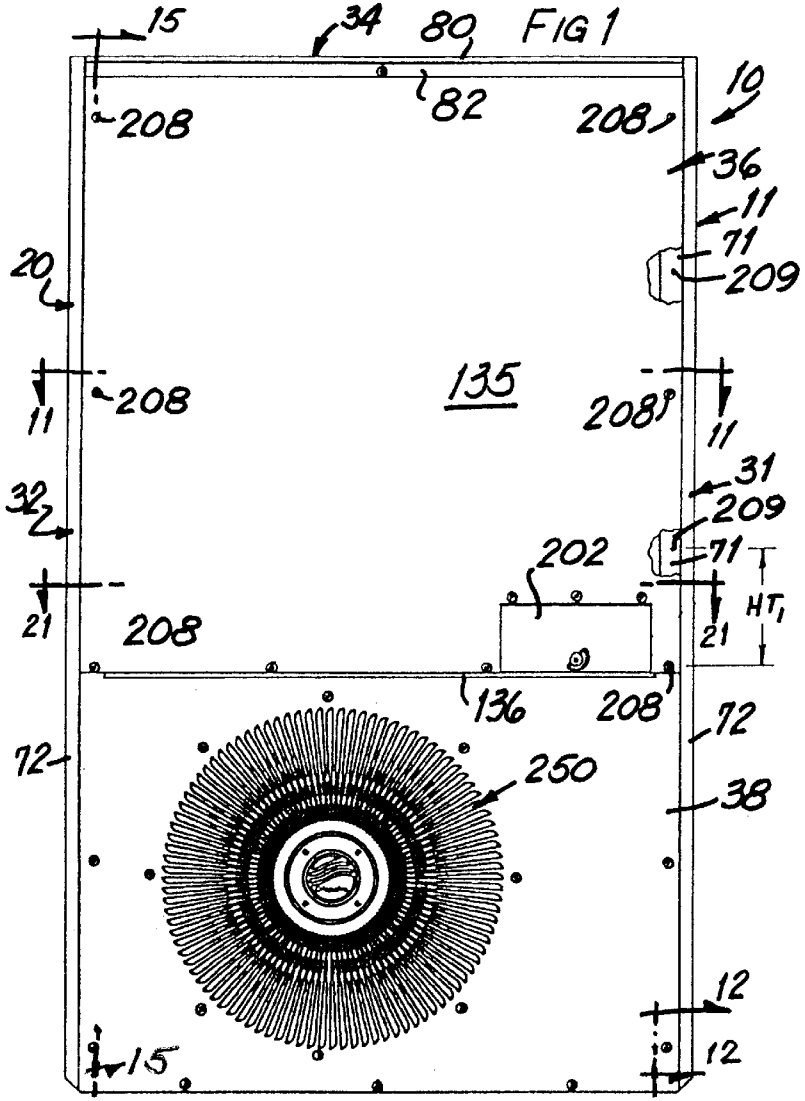
FIG. 1 is a front view of one embodiment of the invention.

Referring generally to FIGS. 1–3, it will be seen that the invention is incorporated in a single package HVAC unit 10 adapted to be mounted on an exterior wall EW (FIG. 5) of a structure that is provided with an air return passage ARP and air supply passage ASP through the wall, usually vertically aligned and spaced apart. The unit 10 includes a cabinet assembly 11 which is mounted on the wall EW over the air return and supply passages ARP and ASP. The cabinet assembly 11 houses the rest of the components of the unit. The cabinet assembly 11 defines an indoor air circulation passage 12 therethrough (FIGS. 6, 15 and 16) in communication with the air return and air supply passages ARP and ASP through the wall when the cabinet assembly is mounted on the wall, and an outdoor air circulation passage 14 therethrough (FIGS. 6 and 14) for circulating outdoor air through the cabinet assembly. Conditioning means 15 (FIG. 6) is provided to condition the air as it passes through the indoor air circulation passage 12 in the cabinet assembly 11 to be supplied back to the space in the structure to be conditioned. Indoor air circulation blower means 16 (FIGS. 6, 15 and 16) is mounted in the cabinet assembly 11 to move the air through the indoor air circulation passage 12 and an outdoor air circulation fan means 18 (FIGS. 6 and 12) is provided to move outdoor air through the outdoor air circulation passage 14.

The cabinet assembly 11 is fabricated in two self-supporting subassemblies, a primary cabinet subassembly 20 (FIG. 6) and a back panel subassembly 21 (FIGS. 4 and 5) to facilitate the mounting of the unit 10 on the wall while at the same time minimizing the manufacturing cost of the unit 10. As will become more apparent, the fact that the cabinet subassemblies are self-supporting allows lightweight back panel subassembly 21 to be mounted on the wall EW while removed from the primary cabinet subassembly 20 and then the heavier primary cabinet subassembly to be mounted on the wall mounted back panel subassembly 21 while the correct fit between the subassemblies 20 and 21 is assured. Also, since each of the subassemblies 20 and 21 are self-supporting, they can be fabricated separately so that access for fabrication is improved without loss of fit between the two subassemblies.

Figure 5:
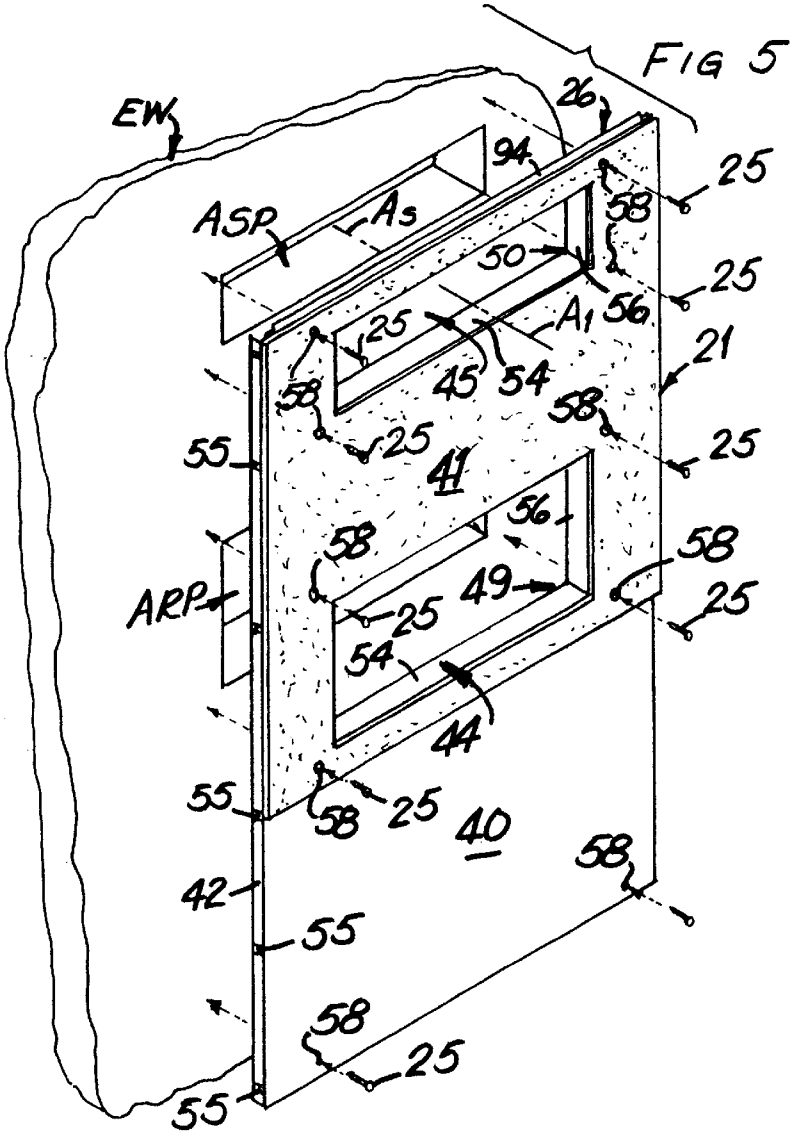
FIG. 5 is an exploded view illustrating the mounting of the back panel subassembly of the invention.

The primary cabinet subassembly 20 mounts conditioning means 15, indoor air circulation blower means 16 and the outdoor air circulation fan means 18 therein so that most of the weight of the unit 10 is in the subassembly 20 and has an open back thereto closed by the back panel subassembly 21. When the back panel subassembly 21 is fitted in the open back of the primary cabinet subassembly 20, it closes same to form the air passages 12 and 14. The back panel subassembly 21 is mounted on the wall over the air return and supply passages ARP and ASP while removed from the primary cabinet subassembly 20 as seen in FIG. 5. The subassembly 21 is provided with air return duct flange 22 that fits into the air return passage ARP through the wall EW and an air supply duct flange 24 that fits into the air supply passage ASP to pneumatically couple the unit 10 to the conditioned space in the structure. This facilitates the mounting of the unit 10 since the installing personnel can easily see the air return and supply passages through the wall and the duct flanges 22 and 24 while the subassembly 21 is being attached to the wall to insure that the air return and supply duct flanges 22 and 24 on back panel subassembly 21 fit within the wall passages. Thus, fire safety and operationally efficiency are assured with the proper fit of the flanges 22 and 24 within the air return and supply passages ARP and ASP respectively. When the back panel subassembly 21 is mounted on the wall EW, the central axis $A_1$ of the air supply duct flange 24 is aligned with the central axis As of the air supply passage ASP through the wall EW. Since the system components are mounted in the primary cabinet subassembly 20, only the much lighter back panel subassembly 21 has to be accurately supported on the wall while the attaching fasteners 25 are installed through the back panel subassembly 21 to mount it on the wall.

By having the back panel subassembly 21 seal the open back of the primary cabinet subassembly 20 so as to form the air passages 12 and 14 through the unit 10, the part count for the cabinet assembly 11 is minimized to reduce manufacturing costs. The primary cabinet subassembly 20 is accessible from both the front and back during manufacture to facilitate the assembly of the unit with the result being reduced manufacturing cost.

Figure 8:
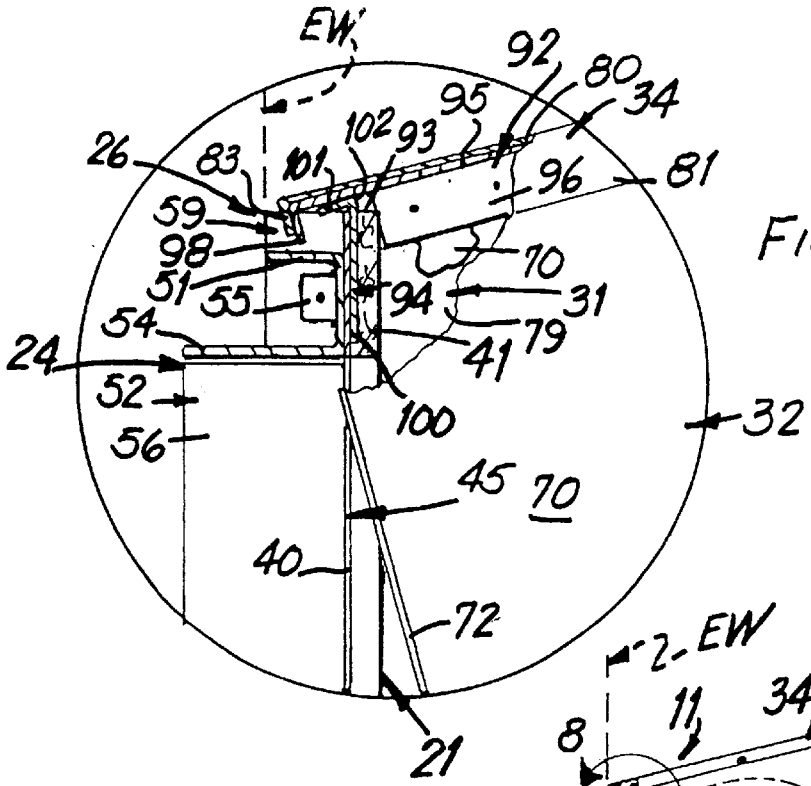
FIG. 8 is an enlarged portion of FIG. 7 taken along line 8—8 in FIG. 7.
Figure 7:
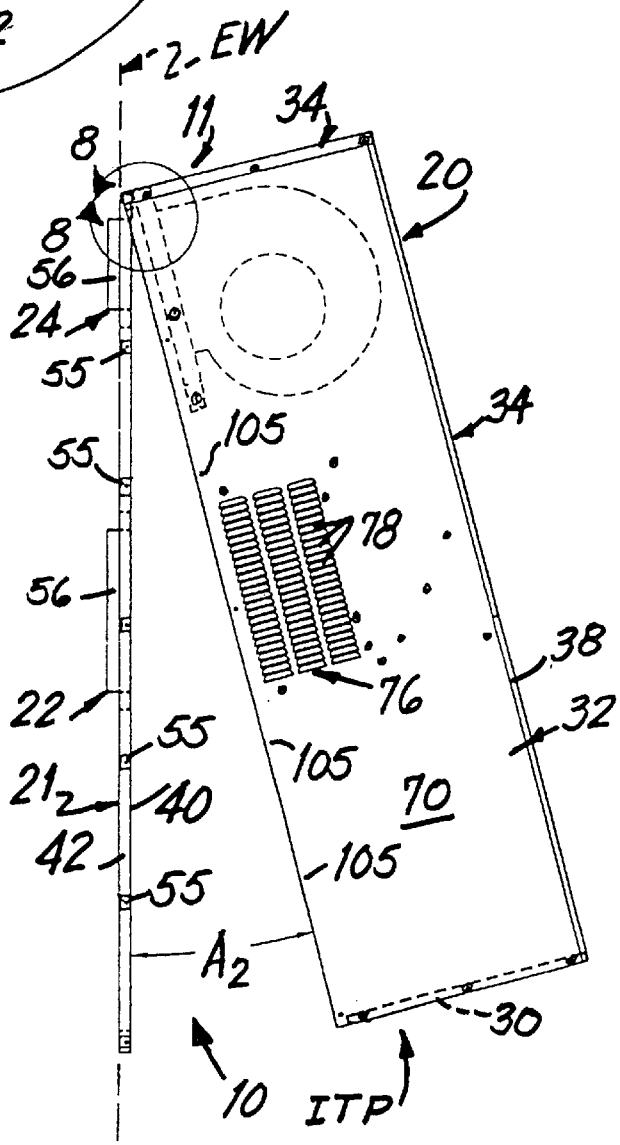
FIG. 7 is a side view illustrating the primary cabinet subassembly supported on the back panel subassembly in the initial tilted position.

Prepositioning means 26 (FIGS. 4, 5, 13, and 14) is provided for interconnecting the primary cabinet subassembly 20 and the back panel subassembly 21 while the primary cabinet subassembly 20 is being installed on the already mounted back panel subassembly 21 to facilitate the alignment of the subassemblies 20 and 21 and to support the primary cabinet subassembly 20 on the back panel subassembly 21 during installation. After the back panel subassembly 21 is mounted on the wall EW, the primary cabinet subassembly 20 is tilted toward the back panel subassembly 21 as seen in FIGS. 7 and 8 at an angle $A_2$ therebetween so that the prepositioning means 26 interconnects the subassemblies 20 and 21 with the subassembly 20 in vertical and lateral alignment with the back panel subassembly 21. The primary cabinet subassembly 20 is then pivoted from the initial tilted position ITP seen in FIG. 7 to the final seated position FSP seen in FIGS. 9 and 10 while the subassembly 20 is supported on the back panel subassembly 21 through the prepositioning means 26. The prepositioning means 26 is constructed such that lateral adjustment of the position of the primary cabinet subassembly 20 relative to the back panel subassembly 21 can be made to insure accurate registration of the primary cabinet subassembly 20 relative to the back panel subassembly 21 in the final seated position FSP. Cabinet connection means 28 (FIG. 2) is provided to connect the primary cabinet subassembly 20 to the back panel subassembly 21 while in the final seat position FSP to seal the subassemblies 20 and 21 to each other and define the air circulation passages 12 and 14 therebetween.

Figure 6:
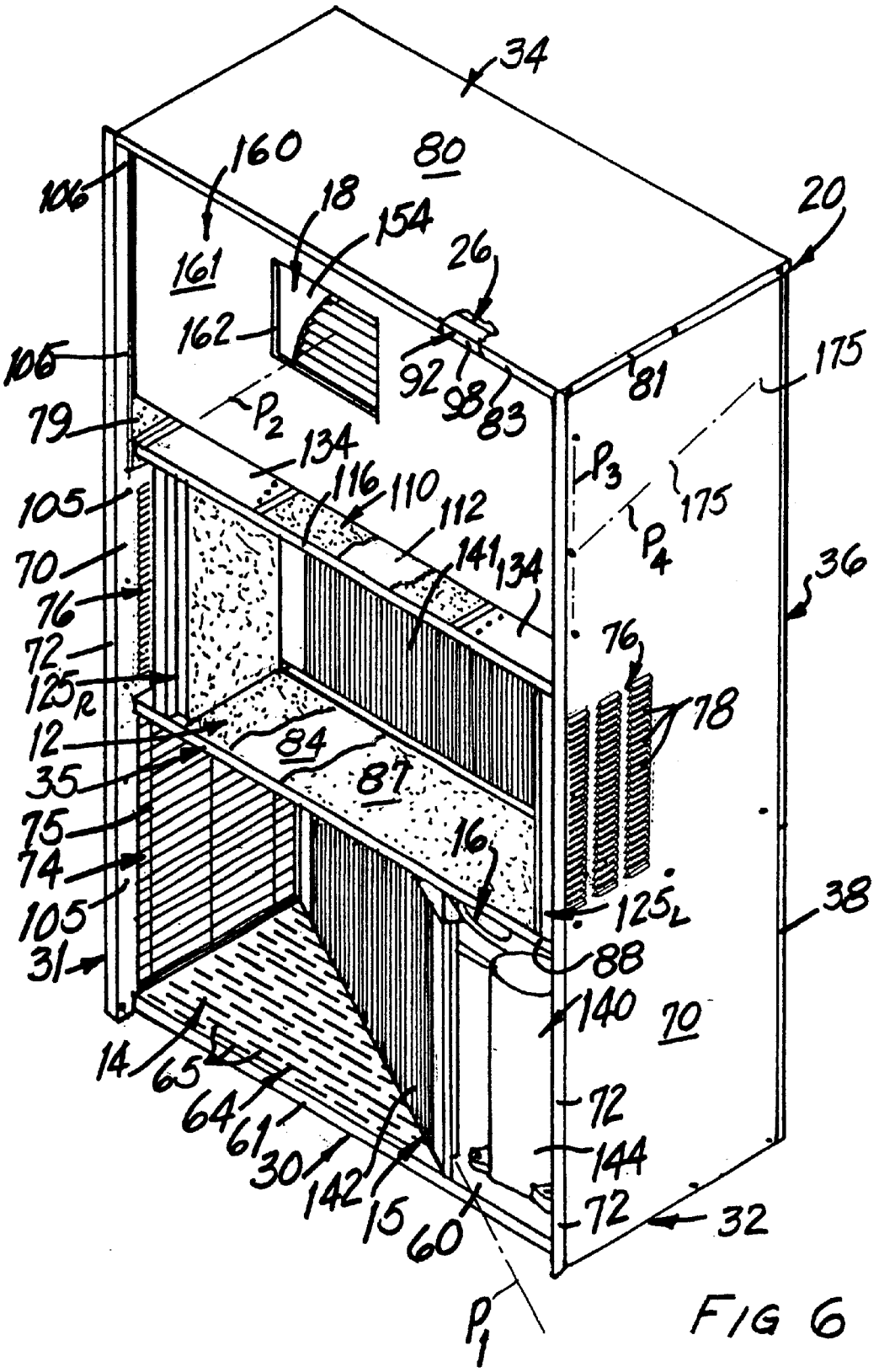
FIG. 6 is a perspective view of the primary cabinet subassembly of the cabinet assembly of the invention.
Figure 11:
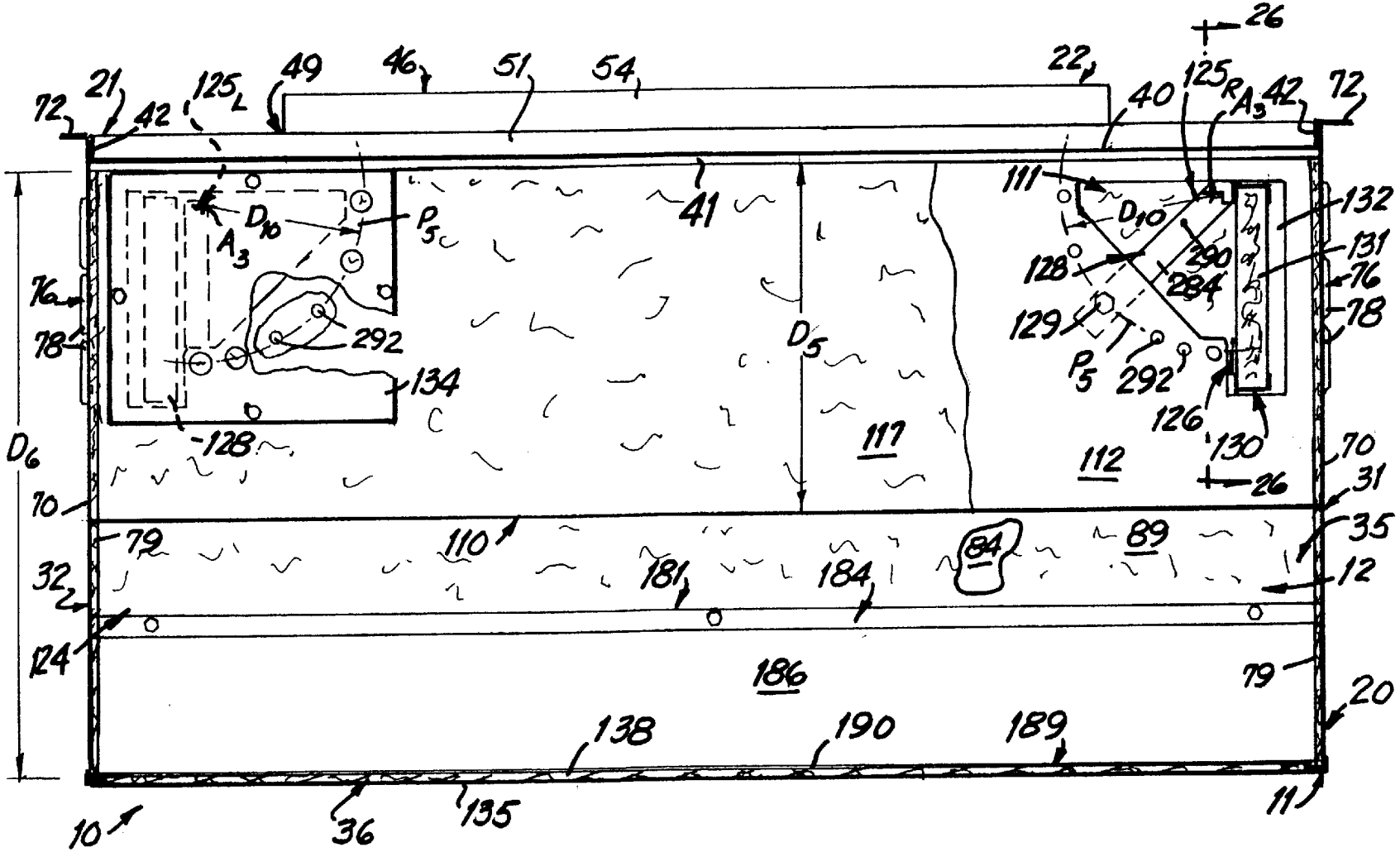
FIG. 11 is an enlarged transverse cross-sectional view of the cabinet assembly taken generally along line 11—11 in FIG. 1 with portions thereof broken away to illustrate the internal construction of the invention.
Figure 15:
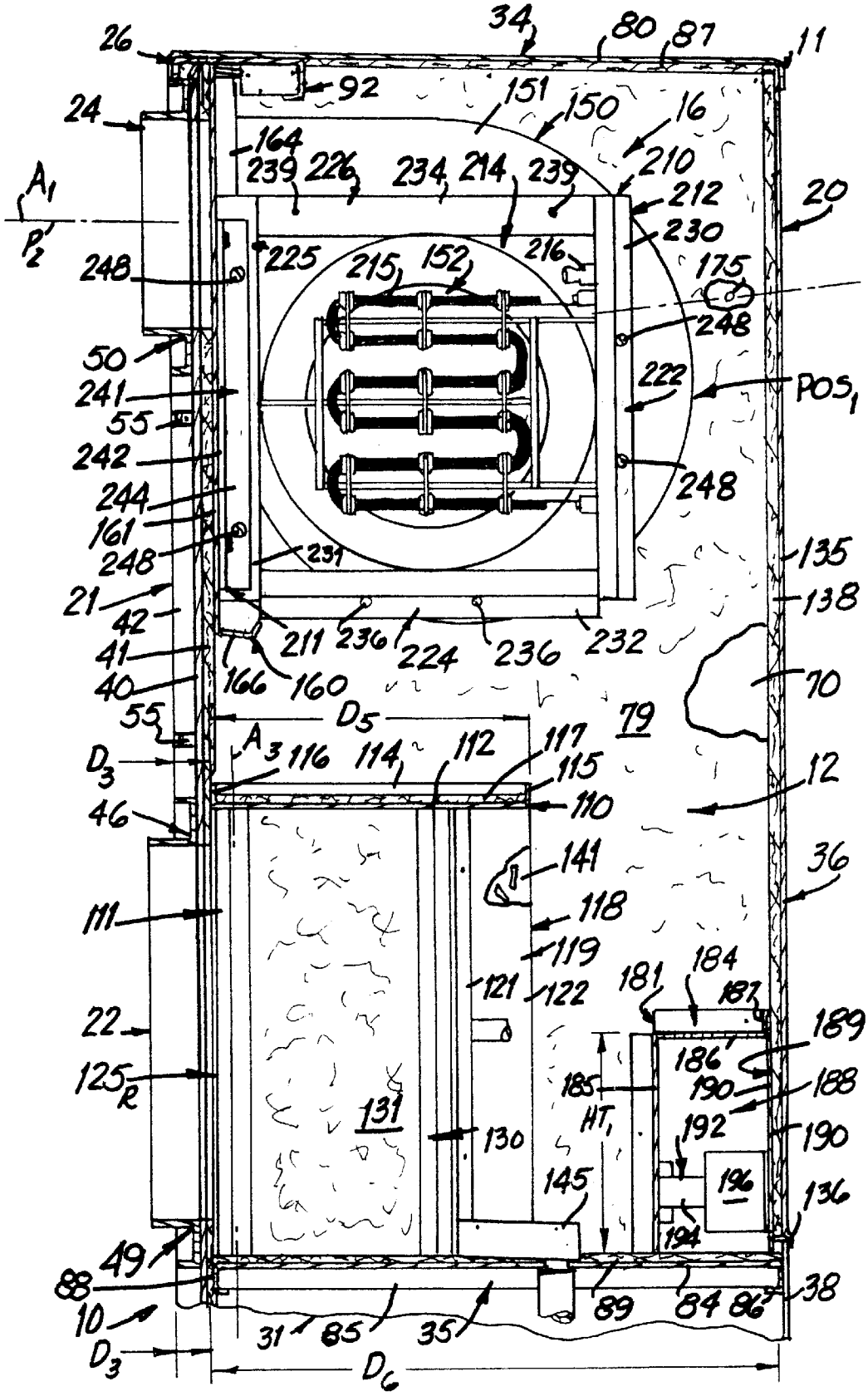
FIG. 15 is an enlarged cross-sectional view taken generally along line 15—15 in FIG. 1 illustrating the indoor blower means in the ducted position.
Figure 16:
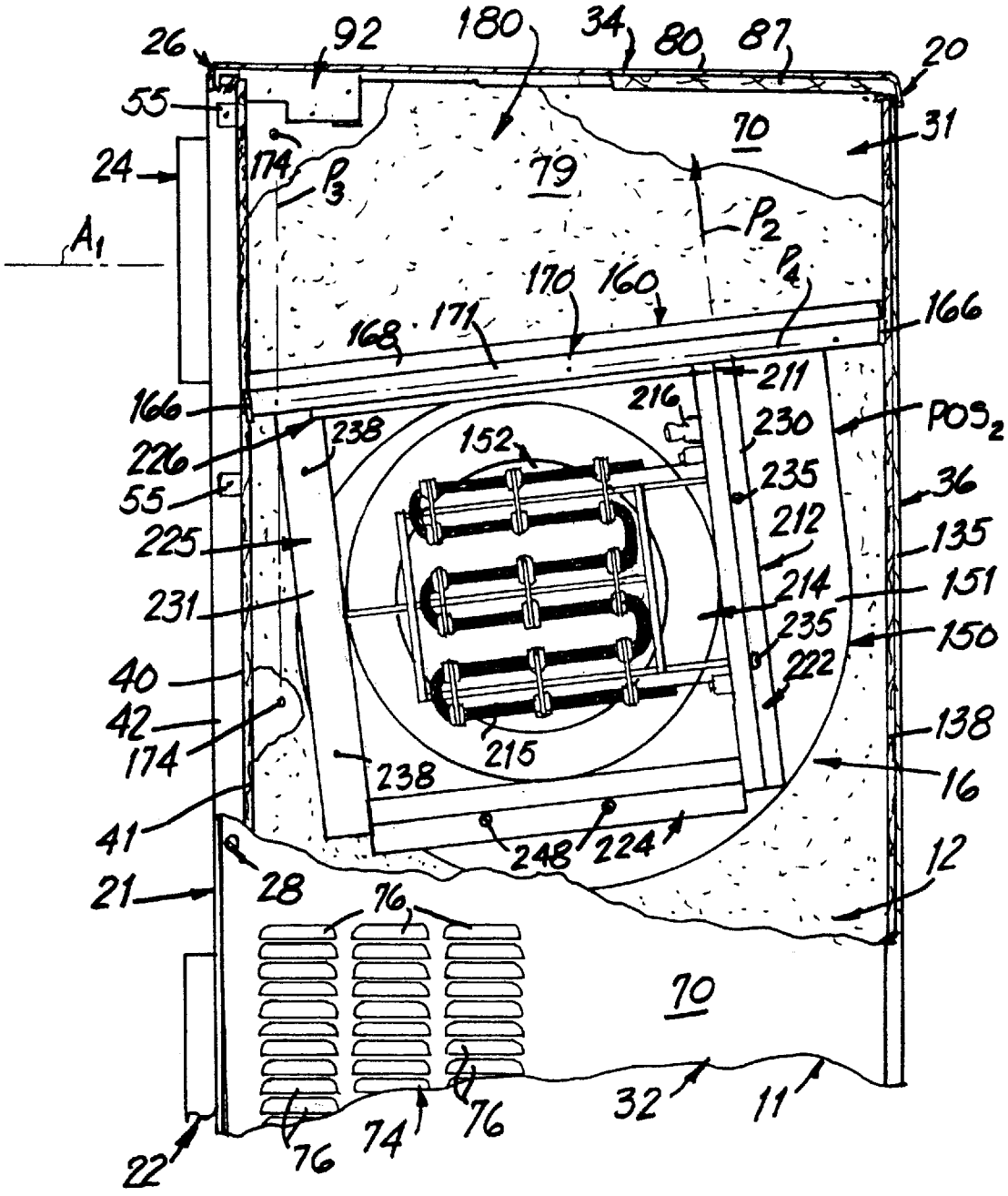
FIG. 16 is an enlarged cross-sectional view taken generally along line 15—15 in FIG. 1 illustrating the indoor blower means in the free blow position.

The primary cabinet subassembly 20 as seen in FIGS. 1, 2, and 6 includes a base pan assembly 30 forming the bottom thereof, a right side panel assembly 31 mounted on the right side of the base pan assembly 30, a left side panel assembly 32 mounted on the left side of the base pan assembly 30 opposite the side panel assembly 31, and a top panel assembly 34 joining the upper ends of the side panel assemblies 31 and 32. A cabinet divider plate assembly 35 joins the side panel assemblies 31 and 32 a prescribed height above the base pan assembly 30 so as to divide the primary cabinet subassembly 20 into an indoor space between the divider plate assembly 35 and the top panel assembly 34 and an outdoor space between the divider plate assembly 35 and the base pan assembly 30. Both of these spaces are open at the front and back of the cabinet subassembly 20. The back panel subassembly 21 closes the open back of the primary cabinet subassembly 20. That portion of the front of the cabinet subassembly 20 above the cabinet divider plate assembly 35 is selectively closed by a front access panel assembly 36 while that portion of the front of the cabinet subassembly 20 below the cabinet divider plate assembly 35 is selectively closed by the outdoor air fan mounting panel 38. When the primary cabinet subassembly 20 is mounted on the back panel assembly 21 and the front access panel assembly 36 and the outdoor air fan mounting panel 38 are in place, the indoor air passage 12 is defined in the cabinet assembly 11 above the cabinet divider plate assembly 35 as best seen in FIGS. 15 and 16 and the outdoor air passage 14 is defined below the divider plate assembly 35 as best seen in FIGS. 6 and 11.

The back panel subassembly 21 seen in FIGS. 3–5 includes a rectilinear back panel 40 with a size and shape corresponding to the open back of the primary cabinet subassembly with insulation 41 on the front side of panel 40 facing the subassembly 20 and extending from just below the level of the cabinet divider plate assembly 35 to the top of the panel 40. The back panel 40 has rearwardly directed vertical side flanges 42 integral with opposite sides thereof and defines an air return opening 44 and air supply opening 45 therethrough having the same spacing and alignment as the air return and supply passages ARP and ASP in the wall EW.

A stiffener framework 46 is mounted on the backside of the back panel 40 to maintain the back panel subassembly 21 substantially flat when it is attached to the wall EW so that the primary cabinet subassembly 20 will properly fit on the back panel subassembly 21. The framework 46 includes a bottom U-shaped channel 48 attached to the lower edge of the back panel 40 on the back side thereof and extending across the full width of the back panel. The framework 46 also includes a return duct flange assembly 49 mounted on the back side of the back panel 40 around the air return opening 44 and an air supply duct flange assembly 50 mounted on the back side of the back panel 40 around the air supply opening 46. Each of the flange assemblies 49 and 50 include horizontally extending upper and lower U-shaped channels 51 that extend across the full width of the back panel 40 just above and below the air return or supply opening 44 or 45 associated therewith and a pair of vertically extending L-shaped angles 52 immediately outside the opening 44 or 45 associated therewith. That leg of the channels 51 in registration with the opening 44 or 45 associated therewith has a flange projection 54 thereon that projects out behind the back panel subassembly 21 to form the air return and supply duct flanges 22 and 24 together with the projecting legs 56 on the angles 52. All of the channels 48 and 51 as well as the angles 52 are attached to the back panel 40 and the vertical L-shaped angles 52 are also attached to the channels 51 to stiffen and strengthen the back panel assembly 21 to keep it flat when installed on the wall. The stiffener framework 46 reinforces the back panel subassembly sufficiently to support the weight of the primary cabinet subassembly 20 thereon. Appropriate mounting holes 58 are provided through the back panel 40 and the channels 48 and 51 for the attaching fasteners 25 to extend into the wall EW to mount the back panel subassembly 21 on the wall. The installer can look through the openings 44 and 45 to visually insure that the flanges 22 and 24 are in registration with the passages ARP and ASP in the wall EW as the subassembly 21 is being installed. Moreover, since the back panel assembly 21 is relatively light as compared with the weight of the entire unit, the installers can easily manually position the subassembly 21 and hold it in place while the fasteners 25 are installed to mount the back panel subassembly 21.

Figure 9:
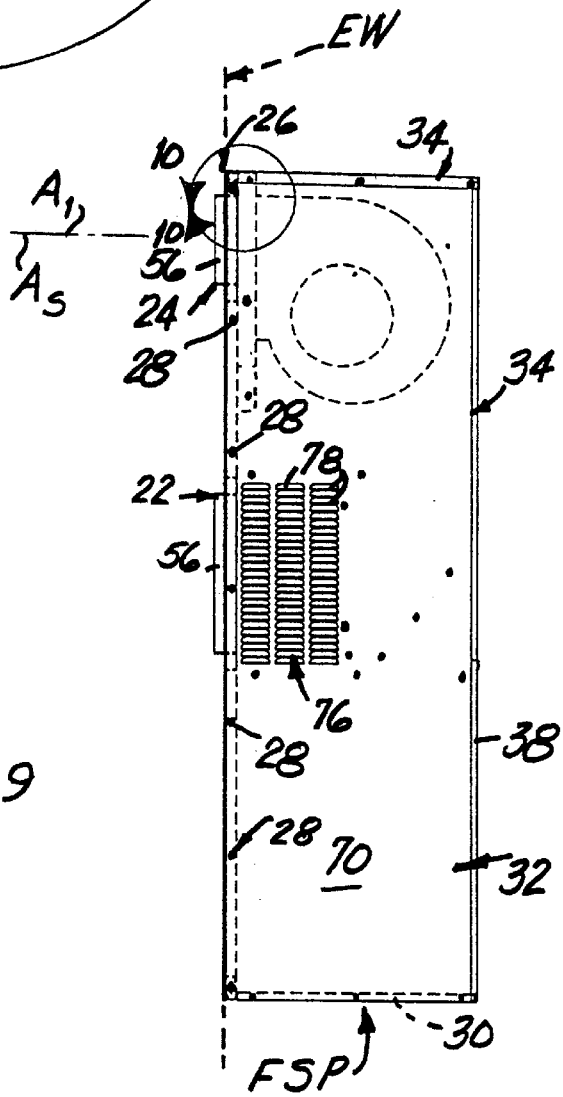
FIG. 9 is a side view illustrating the primary cabinet subassembly supported on the back panel subassembly in the final seated position.

When the back panel subassembly 21 is installed as seen in FIGS. 7 and 9, it will be seen that it projects out from the wall the distance $D_1$ seen in FIG. 13 which is the depth of the side flanges 42 so that the back panel 40 is spaced forwardly of the outside surface of the wall EW this distance. The uppermost U-shaped channel 51 of the air supply duct flange assembly 50 is spaced below the upper edge of the back panel 40 the distance $D_2$ also seen in FIG. 13 to form a clearance space 59 behind the back panel 40 and above the uppermost channel 51 that permits the prepositioning means 26 to interconnect the subassemblies 20 and 21 as will become more apparent. The primary cabinet subassembly 20 is installed over the back panel subassembly 21 so that the rear edges of the side panel assemblies 31 and 32 overlie the side flanges 42 of the subassembly 21.

Figure 4:
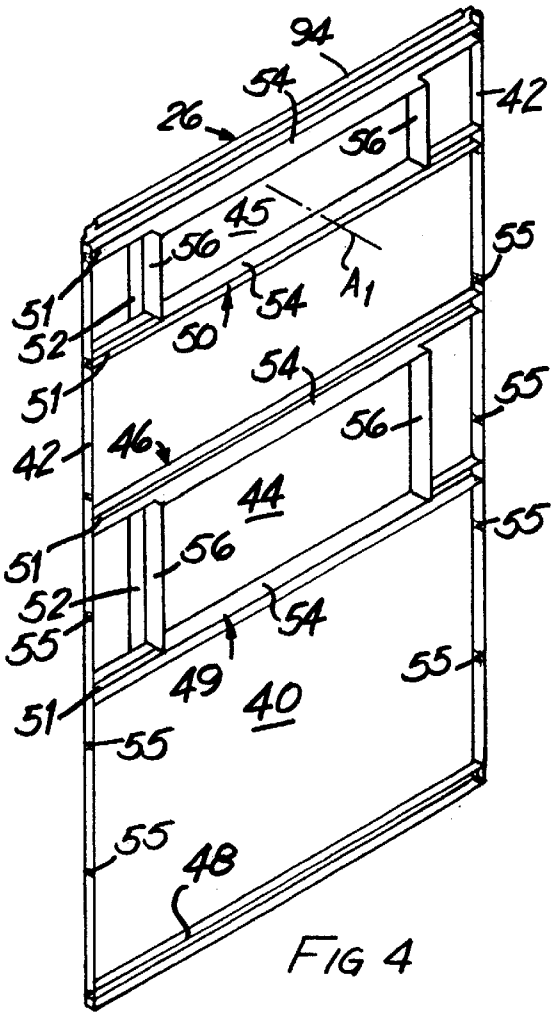
FIG. 4 is a perspective view of the back panel subassembly of the cabinet assembly of the invention.

The side flanges 42 are appropriately slotted to receive appropriate high strength clip nut members 55 such as Tinnerman nuts seen in FIGS. 4, 5, and 13 that are adapted to be threadedly engaged by the cabinet connection means 28, usually threaded fasteners, to fasten the primary cabinet subassembly 20 to the back panel subassembly 21 and seal the open back of the subassembly 20. The strength of the clip nut members 55 is such that sufficient clearance can be provided between the side panels 70 of the side panel assemblies 31 and 31 and the side flanges 42 on the back panel 40 for the primary cabinet subassembly 20 to easily fit over the back panel subassembly 21 yet the connection means 28 can force the side panels 70 and side flanges 42 together to form a seal between the back panel subassembly 21 and the primary cabinet subassembly 20 without damage to the side panels 70 or side flanges 42.

Figure 12:
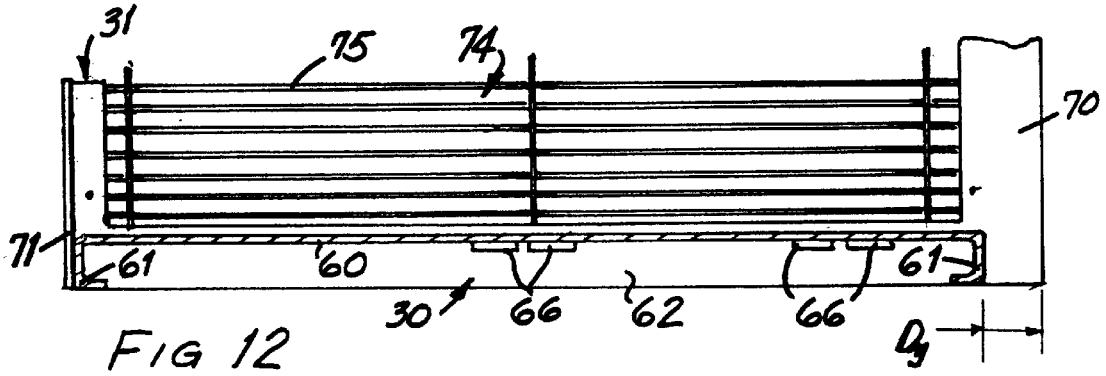
FIG. 12 is an enlarged transverse cross-sectional view of the cabinet assembly taken generally along line 12—12 in FIG. 1.

The base pan assembly 30 seen in FIGS. 6, 11, and 12 includes a rectilinear base pan member 60 provided with downturned L-shaped flanges 61 along the front and back edges of the base pan member 60 to reinforce it and downturned side flanges 62 used to connect the base pan assembly 30 to the lower edges of the side panel assemblies 31 and 32. The base pan member 60 defines the bottom outdoor air inlet 64 therethrough illustrated as a plurality of slots 65. The slots 65 extend through a triangular portion of the base pan member subtended by a diagonal path $P_1$ extending across the member 60 to one end thereof (the right end as viewed from the front of the unit) as best seen in FIG. 11. Compressor mounting nuts 66 (FIGS. 11 and 12) are provided on the base pan member 60 on that side of the path $P_1$ opposite the slots 65.

The right side panel assembly 31 best seen in FIGS. 2, 11 and 12 includes a side panel 70 provided with an integral front inturned flange 71 and an integral back outturned flange 72. The flanges 71 and 72 serve to stiffen the side panel with the front flange serving to mount one side of the front access panel assembly 36 and the outdoor air fan mounting panel 38. The top edge of the side panel 70 is stepped as best seen in FIG. 16 so that the top panel assembly 34 can slope downwardly from the back to the front of the cabinet assembly 11. The lower portion of the right side panel 70 extending from just below the divider plate assembly 35 to just above the base pan assembly 30 is provided with a side outdoor air inlet opening 74 which is covered by an air inlet grill 75 seen in FIGS. 2 and 12. The rear portion of the side panel 70 just above the divider plate assembly 35 is provided with a fresh air inlet opening 76 illustrated in the form of louvers 78 seen in FIG. 2. The inside of the side panel 70 is covered with insulation 79 extending from the divider plate assembly 35 to the top of the panel as best seen in FIGS. 6 and 15 except over the fresh air inlet opening 76.

The left side panel assembly 32 seen in FIGS. 6, 7 and 9 is a mirror image of the right side panel assembly 31 except that no side outdoor air inlet opening is present in the assembly 32. The same reference numbers are applied to those portions of the left side panel assembly 32 corresponding to those of the right side panel assembly 32.

Figure 10:
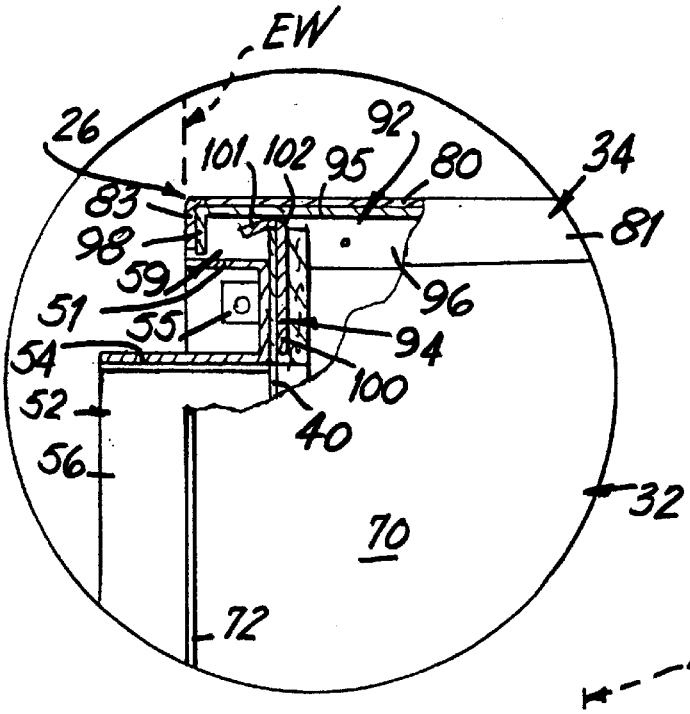
FIG. 10 is an enlarged portion of FIG. 9 taken along line 10—10 in FIG. 9.

The top panel assembly 34 seen in FIGS. 6 and 14–16 includes a top panel 80 with downturned side flanges 81 on opposite ends thereof used to connect the top panel assembly 34 to the side panels 70 so that the top panel 80 slopes downwardly from the back to the front of the primary cabinet subassembly 20 when it is installed on the structure wall. This insures that rain will flow off of the top of the unit. The top panel 80 has a downturned front flange 82 along the front edge thereof which overlaps the top of the front access panel assembly 36 and a downturned rear flange 83 along the back edge thereof which is coplanar with the back edge of the side panels 70. The rear flange 83 will project down into the upwardly opening space 59 in the top of the back panel subassembly 21 as best seen in FIGS. 8 and 10 when the primary cabinet subassembly 20 is installed on the back panel subassembly 21. The interior of the top panel 80 is covered with insulation 87 (FIGS. 14 and 15).

The divider plate assembly 35 best seen in FIGS. 6 and 15 includes a rectilinear divider plate 84 provided with integral downturned side flanges 85 across the opposite end edges thereof used to attach the divider plate assembly 35 to the side panels 70, an integral downturned L-shaped front flange 86 across the front edge thereof used to connect the top edge of the outdoor fan mounting panel 38 and the bottom edge of the front access panel assembly 36 in place, and an integral downturned L-shaped back flange 88 across the back edge thereof which abuts the back panel subassembly 21. The front flange 86 and the rear flange 88 serve to reinforce the plate assembly 35 while the rear flange 88 provides a smooth sealing surface thereon to abut the insulation 41 on the back panel subassembly 21 as will become apparent. The divider plate 84 is sized so that the rearwardly facing sealing surface on the back flange 88 is located a prescribed distance $D_3$ (FIG. 15) forward of the back edge of the side panels 70 where the prescribed distance $D_3$ is selected to be slightly greater than the projecting distance $D_1$ of the side flanges 42 on the back panel subassembly 21 but less that the cumulative projecting depth $D_4$ of flanges 42 and the thickness of the insulation 41 as seen in FIG. 13. In this way, the back flange 88 on the divider plate assembly 35 will be pressed into the insulation 41 to form a seal therewith even though the back flange 88 is not attached to the back panel 40. The top surface of the divider plate 84 is also covered with insulation 89.

It will be appreciated that, when the side panel assemblies 31 and 32 are connected to the base pan assembly 30, the top panel assembly 34, and the divider plate assembly 35, the primary cabinet subassembly 20 is open from the front and the back. This gives maximum access for the installation of components in the primary cabinet subassembly 20 during manufacture without requiring any special jigs or supports to temporary hold the components in place as manufacture progresses. As a result, assembly time and manufacturing cost are minimized.

The prepositioning means 26 includes a reinforcing hook member 92 mounted at the top back of the primary cabinet subassembly 20 and a cooperating hook member 94 mounted at the top of the back panel subassembly 21. The hook member 92 also serves as a reinforcing member to help keep the primary cabinet subassembly 20 in a square condition, that is, with the base pan 60, divider plate 84, and the top panel 80 normal to the side panels 70 even though the back panel subassembly 21 is not in place on the back of the primary cabinet subassembly 20.

Figures 22, 24, 25:
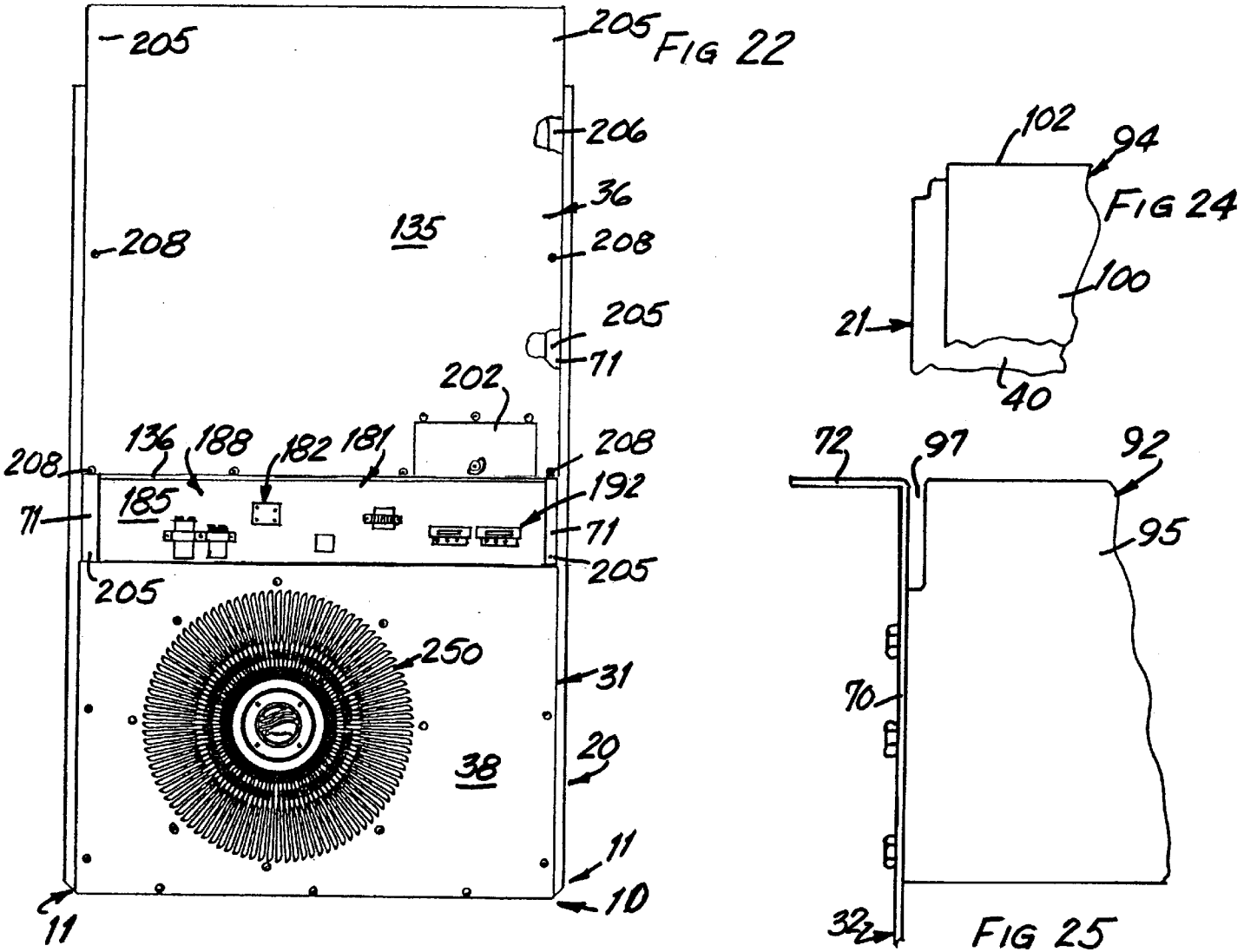
FIG. 22 is a front view similar to FIG. 1 with the front access cover assembly shifted on the primary cabinet subassembly for servicing.
FIG. 24 is an enlarged front view of the upper left corner portion of the back panel assembly.
FIG. 25 is an enlarged top view with the top panel assembly removed of a portion of the upper left back corner portion of the primary cabinet subassembly.

The reinforcing hook member 92 best seen in FIGS. 14 and 25 includes a generally horizontal central support section 95 extending between the side panels 70 and is provided with downturned end mounting flanges 96 at opposite ends thereof that are fastened to the top of the side panels 70 just under the top panel 80 adjacent the rear edge of the panels 70. The back edge of the central support section 95 is provided with a downturned hook flange 98. The hook member 92 is mounted between the side panels so that the support section 95 lies juxtaposed underneath the rear portion of the top panel 80 while the downturned hook flange 98 lies against the front side of the rear flange 83 on the top panel 80 as seen in FIG. 14. The end flanges 96 are provided with clearance cutouts 93 adjacent the back edge of the side panels 70 to clear the upper ends of the back panel subassembly 21 as best seen in FIG. 14. The hook flange 98 is slightly shorter than the central support section 95 and the inside distance between the side flanges 42 on the back panel 40 and is centered on the support section 95 so as to define a clearance space 97 at opposite ends of the flange 98 as seen in FIG. 25 to clear the side flanges 42 when the flange 98 is inserted into the upwardly opening space 59 behind the top of the back panel 40. The clearance spaces 97 are sized to permit the primary cabinet subassembly 20 to be moved slightly from side-to-side to allow the side panels 70 to be aligned with the back panel 40 without the hook flange 98 interfering with the side flanges 42.

The front edge of the central web section 95 is provided with a depending L-shaped reinforcing flange 99 extending across the width of the primary cabinet subassembly 20 to strengthen the hook member 92 and also maintain the subassembly 20 in a square condition. It will be understood that the hook member 92 may be assembled in the primary cabinet subassembly 20 before the top panel assembly 34 is installed to simplify assembly. Once the hook member 92 is installed, the primary cabinet subassembly 20 will be maintained square even though the front and back of the cabinet subassembly 20 remains open so that final assembly of the subassembly 20 can proceed while assuring that manufacturing tolerances will be maintained.

The hook member 94 on top of the back panel subassembly 21 as seen in FIGS. 3, 13, and 24 includes an upstanding flat base section 100 attached to that portion of the back panel 40 adjacent the top edge thereof. The upper edge of the base section 100 is provided with a short support flange 101 integral therewith that projects rearwardly and downwardly from the upper edge of the base section 100 to form an upwardly facing rounded bearing edge 102 thereon adapted to support the hook member 92 on the primary cabinet subassembly 20. The flange 101 is sufficiently short to leave an opening 104 between the projecting edge of the flange 101 and the wall EW when the back panel subassembly 21 is mounted on the wall through which the depending hook flange 98 on the hook member 92 can project into the clearance space 59 behind the top of the back panel assembly 21. This lets the bearing edge 102 on the hook member 94 to engage the underside of the central support section 95 to support the primary cabinet subassembly 20 on the back panel subassembly 21. The hook flange 98 keeps the hook member 92 on the primary cabinet subassembly 20 engaged with the hook member 94 on the back panel subassembly 21 to maintain the interconnection between the subassemblies 20 and 21 after the primary cabinet subassembly 20 is tilted back at its upper end to the initial tilted position ITP and moved so that the hook member 92 is hooked onto the hook member 94 as shown in FIGS. 7 and 8. The side flanges 42 on the back panel 40 maintain the hook flange 98 therebetween to keep the primary cabinet subassembly 20 in lateral alignment with the back panel subassembly 21. If the primary cabinet subassembly 20 is not perfectly centered on the back panel assembly 21, the bearing edge 102 on the hook member 94 allows the primary cabinet subassembly 20 to be shifted laterally until lateral registration is achieved.

Once registration is achieved in the initial tilted position ITP, support of the primary cabinet subassembly 20 is slowly removed. The weight of the primary cabinet subassembly 20 and the components housed therein inherently causes the primary cabinet subassembly to swing down over the back panel subassembly 21 to the final seated position FSP seen in FIGS. 9 and 10 so that the back panel subassembly closes the open back of the primary cabinet subassembly 20. To make sure that the cabinet subassembly 20 is fully seated on the back panel subassembly 21, the primary cabinet subassembly 20 can be easily manually shifted toward the wall EW because the central support section 95 on the hook member 92 can slide over the bearing edge 102 on the hook member 94.

Cabinet connection holes 105 seen in FIGS. 6 and 7 are provided through the side panels 70 adjacent the back edge thereof and are constructed and arranged so that they are in registration with the clip nut members 55 on the back panel subassembly 21 when the primary cabinet subassembly 20 is in its final seated position FSP. The cabinet connection means 28 includes the connection holes 105, the clip nut members 55 and fasteners 106 (FIGS. 1 and 9) that are threaded into the nut members 55 through the holes 105. The strength of the nut members 55 is sufficient to allow the fasteners 106 to tightly clamp the side panels 70 to the back panel side flanges 42 to seal the primary cabinet subassembly 20 to the back panel subassembly 21 while allowing enough clearance initially between the side flanges 42 and side panels 70 for the primary cabinet subassembly to be easily placed over the back panel subassembly.

A fresh air damper subchamber forming assembly 110 seen in FIGS. 6, 11, 15, and 21 is provided to form a damper subchamber 111 in the air passage 12 through the cabinet assembly 11 immediately downstream of the air return opening 44 in the back panel subassembly 21. The subchamber forming assembly 110 comprises a rectilinear damper divider plate 112 connected between the side panels 70 just above the fresh air inlet openings 76 through the side panels and oriented parallel to the divider plate 84 of the divider plate assembly 35. Opposite ends of the divider plate 112 are provided with integral upturned side flanges 114 used to connect the divider 112 in place between the side panels 70, an integral upstanding front reinforcing flange 115 is provided across the front edge of plate 112, and an integral upstanding back flange 116 is provided across the back edge of plate 112. The depth $D_5$ of the damper divider plate 112 is about 60% of the depth $D_6$ of the divider plate 84 separating the indoor and outdoor sections of the cabinet assembly 11 as seen in FIGS. 11 and 15 so that a gap 124 is left between the front of the plate 112 and the front panel assembly 36 for the free flow of the air being recirculated back to the conditioned space is provided as will become more apparent.

The subassembly 110 is mounted between the side panels 70 so that the rearwardly facing sealing surface on the back flange 116 is spaced forwardly of the back edge of the side panels 70 substantially the same prescribed distance $D_3$ as the sealing surface on the flange 88 of the divider plate subassembly 35 to insure a seal with the back panel subassembly 21. Thus, when the primary cabinet subassembly 20 is mounted on the back panel subassembly 21, a seal is formed around the air return opening 44 through the back panel 40 as best seen in FIG. 15 to define the open front damper subchamber 111 in the air passage 12 bounded by the divider plates 84 and 112, the end panels 70, and the back panel 40. In this way, the air returning from the conditioned space through the air return opening 44 will pass through the damper subchamber 111, out the open front of the subchamber 111, and then upwardly through the gap 124 for recirculation.

Figure 21:
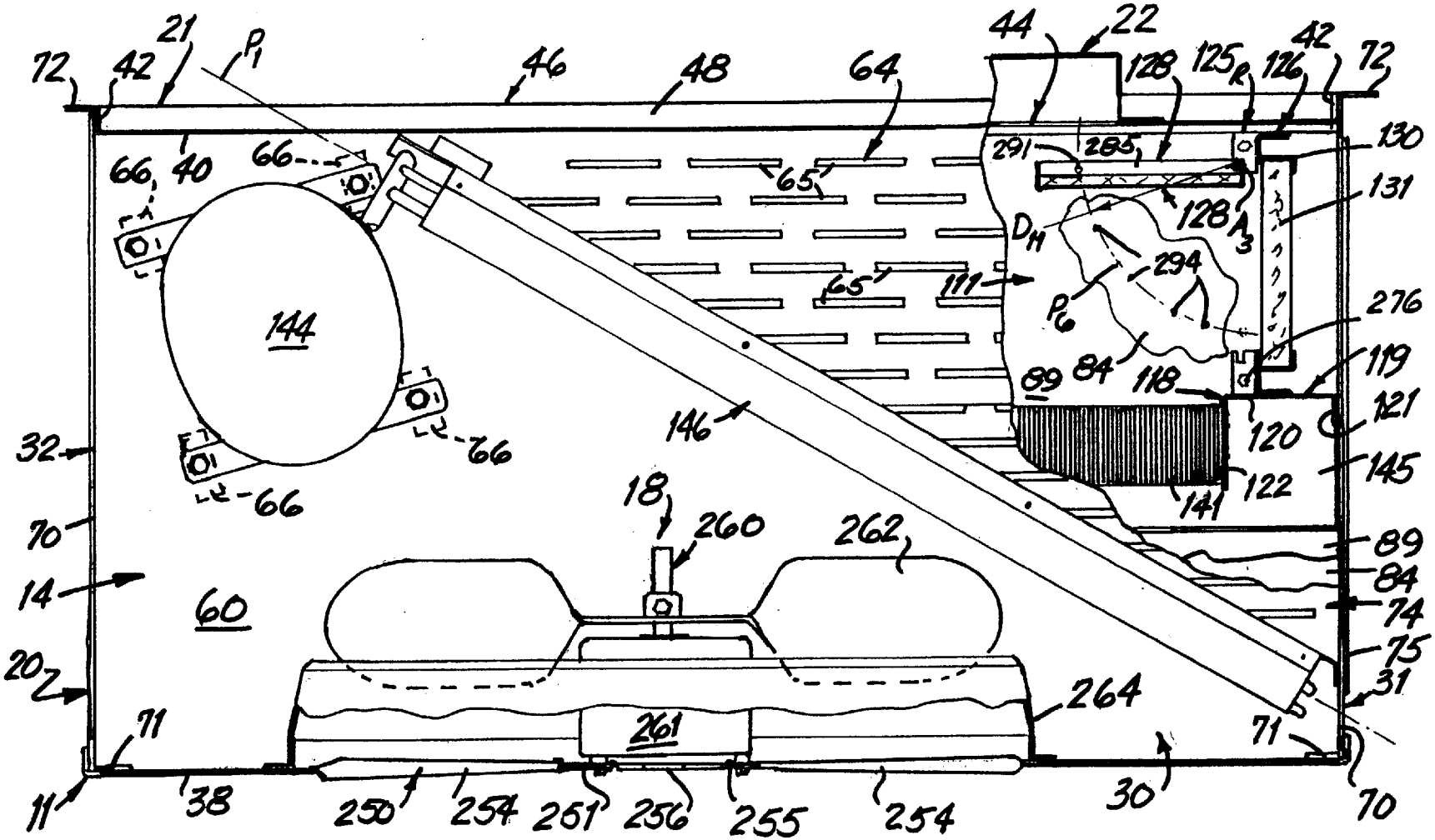
FIG. 21 is an enlarged cross-sectional view taken generally along line 21—21 in FIG. 1 with portions thereof broken away to illustrate the outdoor section.

The subchamber forming assembly 110 also includes an indoor coil mounting assembly 118 best seen in FIGS. 15 and 21 mounted between the divider plates 84 and 112 at front opening to the damper subchamber 111. The assembly 118 includes a pair of spaced apart coil mounting angles 119 extending between the divider plates 84 and 112, each having a base leg 120 oriented parallel to the back panel 40 with a side flange 121 along the outboard edge thereof used to attach the angle 119 to the adjacent side panel 70, and a mounting leg 122 along the inboard edge of the base leg oriented parallel to the side panel 70. The flanges 121 are sealingly attached to the side panels 70 just forward of the fresh air inlet opening 76 through the side panel 70 while the mounting legs 122 define a coil opening therebetween to receive the indoor coil as described hereinafter. The mounting angles 119 in combination with the divider plates 84 and 112 form a structure that also helps maintain the primary cabinet subassembly 20 in a square condition to facilitate its installation on the back panel assembly 21.

A pair of fresh air damper assemblies 125 seen in FIGS. 6, 11, 15, and 21 are provided to control the amount of fresh air induced into the air stream circulating through the damper subchamber 111. One of the damper assemblies 125 is positioned in the subchamber 111 just inboard of the fresh air inlet opening 76 in each side panel 70. Each damper assembly 125 utilizes the same components but can be configured so as to be used as the right side damper assembly $125_R$ or the left side damper assembly $125_L$ as seen in FIGS. 11 and 21 as will become more apparent.

Each damper assembly 125 illustrated in detail in FIGS. 26–28 includes a vertically oriented damper frame assembly 126 pivotally mounting a damper door assembly 128 thereon for selectively controlling the amount of fresh air induced into the circulating air stream through the fresh air inlet opening 76 in the adjacent side panel 70.

Each damper frame assembly 126 best seen in FIGS. 26–28 includes spaced apart angle members 270 adapted to be mounted in the subchamber 111 between the divider plates 84 and 112. Each angle member 270 has a vertically oriented base leg 271 and a vertically oriented sealing leg 272 normal to and integral with the base leg 271.

One end of sealing leg 272 is provided with a horizontally oriented mounting flange 274 normal to the leg 272 while the opposite end of the leg 272 is provided with a horizontally oriented mounting flange 275 that is a mirror image of the flange 274. The mounting flanges 274 and 275 are used to attach the damper frame assembly 126 to the divider plates 84 and 112 using fasteners 276 seen in FIGS. 21 and 26 and thus mount the damper assembly 125 in the damper subchamber 111.

The projecting corner of the mounting flange 274 opposite the sealing leg 272 has a bendable pivot tab 278 formed therein which is initially coplanar with the mounting flange 274. Likewise, the projecting corner of the mounting flange 275 opposite the sealing leg 272 has a bendable pivot tab 279 formed therein which is initially coplanar with the mounting flange 275. As will become more apparent, the damper door assembly 128 can be pivotally mounted between the mounting flanges 274 and 275 on one of the angle members 270 by bending the tab 278 on the mounting flange 274 toward the opposed mounting flange 275 until tab 278 is normal to the mounting flange 274 and by bending the tab 279 on the mounting flange 275 toward the opposed mounting flange 274 until the tab 279 is normal to the mounting flange 275. Thus, the bent tabs 278 and 279 are coaxially aligned along the common axis $A_3$ as seen in FIG. 26. When the pivot tabs 278 and 279 are not used to pivotally mount one side of the door assembly 128, they are left coplanar with the mounting flanges 274 and 275 as will be explained.

That side of the sealing leg 272 facing the mounting flanges 274 and 275 is provided with a sealing strip 280 adapted to seal the edges of the door assembly 128 to the frame assembly 126. The sealing strips 280 are constructed to allow either side of the door assembly 128 to be pivoted as will become more apparent.

This construction allows a common angle member 270 to be used both the front and back sides of the damper assembly 126 and for both the right side and left side fresh air damper assemblies $125_R$ and $125_L$ simply by properly orienting the angle member 270. An explanation of the orientation of the angle member 270 for the right side assembly $125_R$ illustrated in FIGS. 26–28 will be made for illustrative purposes. For the right side damper assembly $125_R$, the door assembly 128 is to be pivoted on the angle member toward the back of the unit 10 and designated as $270_{BR}$ while the angle member toward the front of the unit 10 is designated $270_{FR}$. The pivot tabs 278 and 279 on the back angle member $270_{BR}$ are bent normal to the mounting flanges 274 and 275. The member $270_{BR}$ is oriented so that mounting flange 274 is uppermost and the mounting leg 271 projects outwardly toward the side panel 70. The front angle member $270_{FR}$ is oriented so that the mounting flange 275 is uppermost and the mounting leg 271 projects outwardly toward the side panel 70.

The back angle member $270_{BR}$ is mounted in the subchamber 111 with the base leg 271 coplanar with the back sealing surfaces on the back flange 88 of the divider plate 84 and the back flange 116 on the damper divider plate 112 by the fasteners 276 extending through the mounting tab 274 into the damper divider plate 112 and by the fastener 276 extending through the mounting flange 275 into the cabinet divider plate 64. The front angle member $270_{FR}$ is mounted in the subchamber 111 with the base leg 271 against the back side of the base leg 120 of the coil mounting angle 119 by the fastener 276 extending through the mounting flange 274 into the cabinet divider plate 84 and by the fastener 276 extending through the mounting flange 275 into the damper divider plate 112. The angles 270 thus seal with the back panel subassembly 21 and the coil mounting angle 119 so that the forwardly projecting sealing leg 272 on the back angle $270_{BR}$ and the rearwardly projecting sealing leg 272 on the front angle $270_{FR}$ define a damper air opening 281 therebetween.

It will be appreciated that the left side damper assembly $125_L$ has the angle members 270 arranged so that the left side damper assembly $125_L$ is a mirror image of the right side damper assembly $125_R$ when viewed from the interior of the unit looking out. Thus, the back angle 270 on the left side damper assembly $125_L$ will have the mounting flange 275 uppermost and the pivot tabs 278 and 279 on the back angle 270 will be bent to pivot the door assembly 128 thereon. The front angle 270 will have unbent tabs 278 and 279 with the mounting flange 274 uppermost.

The damper door assembly 128 as seen in FIGS. 26–28 includes a rectilinear door 282 with a vertical centerline $CL_V$. The door 282 is sized to fit over the damper opening 281 and overlap the sealing strips 280 on sealing legs 272 of the angle members 270. The door 282 is provided with parallel top and bottom flanges 284 and 285 respectively as seen in FIGS. 26–28 which project out from the door 282 opposite the sealing legs 272 on the angles 270 as well as front and back side flanges 286 to reinforce the door 282.

A pivot hole 288 is provided through each end of the top flange 284 and a like pivot hole 289 is provided through each end of the bottom flange 285, all equally spaced from the door centerline $CL_V$, so that the pivot hole $288_1$ in one end of the top flange 279 is aligned with the pivot hole $289_1$ in the corresponding end of the bottom flange 285 about a common centerline $CL_1$ while the pivot hole $288_2$ in the opposite end of the top flange 284 is aligned with the hole $289_2$ in the corresponding end of the bottom flange 285 about common centerline $CL_2$. It will thus be seen that the centerlines $CL_1$ and $CL_2$ are parallel to the door centerline $CL_V$ and equally spaced the distance $D_8$ on opposite sides thereof. Either the pivot holes $288_1$ and $289_1$ or the pivot holes $288_2$ and $289_2$ may be used to pivot the door 282 about the vertical axis $A_3$ depending which side of the door 282 needs to be pivoted. Thus, on the right side damper assembly $125_R$ as illustrated in FIGS. 26–28, the holes $288_1$ and $289_1$ are used to pivot the door 282 about the axis $A_3$. On the other hand, the left side damper assembly $125_L$ is pivoted using the holes $288_2$ and $289_2$. Likewise, it will be appreciated that the same door 282 is used in both the right and left side damper assemblies.

The top flange 284 on the door 282 is also provided with a pair of positioning pilot holes $290_1$ and $290_2$ therethrough equally spaced a prescribed distance $D_9$ from the door centerline $CL_V$ as best seen in FIG. 27 while the bottom flange 285 is provided with a pair of positioning holes $\mathbf{291}_1$ and $\mathbf{291}_2$ therethrough also equally spaced the prescribed distance $D_9$ from the door centerline $CL_V$ as best seen in FIG. 28. It will thus be seen that the pilot hole $\mathbf{290}_2$ in the top flange 284 is spaced the radial distance $D_{10}$ from the pivot hole $\mathbf{288}_1$ on the opposite side of the door centerline $CL_V$ while the pilot hole $\mathbf{290}_1$ is spaced the same radial distance $D_{10}$ from the pivot hole $\mathbf{288}_2$ as best seen in FIG. 27. Likewise, the positioning hole $\mathbf{291}_2$ in the bottom flange 285 is spaced the radial distance $D_{11}$ from the pivot hole $\mathbf{289}_1$ on the opposite side of the door centerline $CL_V$ while the positioning hole $\mathbf{291}_1$ is spaced the same radial distance $D_{11}$ from the pivot hole $\mathbf{289}_2$ as best seen in FIG. 28. The pilot holes 290 or the positioning holes 291 are used to selectively fix the door assembly 128 at different pivoted positions as will become more apparent so that the amount of outside air induced into the circulating air stream can be selectively varied.

To cooperate with the positioning pilot holes 290 in the door assembly 128, a plurality of positioning holes 292 are provided adjacent opposite ends of the subchamber divider plate 112 (FIG. 11) along an arcuate path $P_5$ centered on the axis $A_3$ and located the same radial distance $D_{10}$ therefrom as the positioning pilot hole $\mathbf{290}_2$ is from the pivot hole $\mathbf{288}_1$ or the positioning pilot hole $\mathbf{290}_1$ is located from the pivot hole $\mathbf{288}_2$ through top flange 284. Similarly, a plurality of positioning pilot holes 294 are provided adjacent opposite ends of the cabinet divider plate 84 (FIG. 21) along an arcuate path $P_6$ centered on the axis $A_3$ and located the same radial distance $D_{11}$ therefrom as the positioning hole $\mathbf{291}_2$ is from the pivot hole $\mathbf{289}_1$ or the positioning hole $\mathbf{291}_1$ is located from the pivot hole $\mathbf{289}_2$ through the bottom flange 285.

When the door assembly 128 is positioned within the right side of the subchamber 111 as seen in FIG. 11 with the pivot holes $\mathbf{288}_1$ and $\mathbf{289}_1$ will be used to pivot the door assembly 128, the positioning pilot hole $\mathbf{290}_2$ is registrable with any one of the positioning holes 292 in the right hand end of the damper divider plate 112. Also, the positioning hole $\mathbf{291}_2$ is registrable with any one of the positioning pilot holes 294 in the right hand end of the cabinet divider plate 112. A locating fastener 129 is used to selectively fix the door assembly 128 in the right damper assembly $\mathbf{125}_R$ at any of the prescribed positions established by the holes 292 or 294.

If access for adjustment of the door assembly 128 is to be through the front of the cabinet assembly 11 after the front access panel assembly 36 is removed, then the locating fastener 129 is installed from the top of the damper divider plate 112 through the selected positioning hole 292 and screwed into the pilot hole $\mathbf{290}_2$ in the top flange 284 on the door 282 as illustrated in FIG. 11. On the other hand, if the adjustment of the damper assembly $\mathbf{125}_R$ is to be made through the air return opening 44, the locating fastener 129 is installed from within the damper subchamber 111 through the positioning hole $\mathbf{291}_2$ and screwed into the selected positioning pilot hole 294 in the cabinet divider plate 84 seen in FIG. 21.

The door assembly 128 positioned within the left side of the subchamber 111 will be pivoted on the left side back angle member 270 using the pivot holes $\mathbf{288}_2$ and $\mathbf{289}_2$ so that the positioning pilot hole $\mathbf{290}_1$ in the top flange 284 is registrable with any one of the positioning holes 292 in the left hand end of the damper divider plate 112 and the positioning hole $\mathbf{291}_1$ is registrable with any one of the positioning pilot holes 294 in the left hand end of the cabinet divider plate 84. The locating fastener 129 will be installed similarly to that described above for the right damper assembly $\mathbf{125}_R$.

To filter the fresh air passing into the damper subchamber through the fresh air inlet opening 76 through the side panel 70, a filter mounting assembly 130 is provided on the upstream side of the damper frame assembly 126 as seen in FIGS. 15 and 21 to removably support a filter media 131 such as a hogshair filter so that it can be removed upwardly out of the mounting assembly 129. An appropriate access cutout 132 is provided through the divider plate 112 over the filter mounting assembly 126 for the filter media 131 to pass for replacement and a filter cover 134 is provided to seal the cutout 132. The access cutout 132 also allows access to the damper assembly 125 for manually positioning it when adjustment is to be made for the front of the unit 10 as explained hereinbefore.

The front access panel assembly 36 seen in FIGS. 1, 15, and 16 includes a rectilinear front access panel 135 sized to cover the open front of the primary cabinet subassembly 20 and is provided with side flanges that overlap the front vertical corners of the side panels 70, a top reinforcing flange that extends under the downturned flange 81 on the top panel 80, and a bottom offset projection 136 that overlaps the top of the outdoor air fan mounting panel 38. The interior of the front access panel 135 is covered with insulation 138.

The conditioning means 15 is illustrated as a refrigeration circuit 140 with an indoor coil 141, an outdoor coil 142 and a compressor 144 seen in FIG. 6. The indoor coil 141 is mounted in the coil opening at the front of the damper subchamber 111 between the mounting legs 122 of the indoor coil mounting assembly 118 so that the air passing out of the damper subchamber 111 must pass through the indoor coil 141. It will be appreciated that the coil 141 is spaced from the front of the primary cabinet subassembly 20 so that the air freely passes out of the coil 141 into the rest of the air passage 12 downstream of the coil. Because the longest dimension of the indoor coil 141 is horizontally oriented and the coil sits in a drain pan 145 supported on the divider plate 84, the space downstream of the coil 141 is maximized as will become more apparent.

The outdoor coil 142 is a straight coil that is mounted in the outdoor space below the divider plate 84 by the outdoor coil mounting assembly 146 so that the coil is oriented along the diagonal path $P_1$ as seen in FIGS. 6 and 21. The mounting assembly 146 seals the bottom of the coil to the base pan member 60, seals the top of the coil to the divider plate 84, seals the forwardmost end of the coil to the right side panel 70 just forward of the side outdoor air inlet opening 74, and, when the primary cabinet subassembly 20 is mounted on the back panel subassembly 21, seals the rearmost end of the coil to the back panel 40. Thus, the outdoor coil 142 with the mounting assembly 146 divides the outdoor space into an inlet chamber upstream of the coil 142 and a discharge chamber downstream of the coil 142. The compressor 144 is mounted on the base pan member 60 through the compressor mounting nuts 55 in the discharge chamber downstream of the coil 142. Since the outdoor air flows through the coil 142 from the upstream side to the downstream side, the heat generated by the compressor is dissipated in the outdoor air after it passes through the outdoor coil 142.

The indoor air circulation means 16 best seen in FIGS. 6 and 15–19 includes a conventional centrifugal blower 150 with a blower housing 151 defining inlet openings 152 in opposite sides thereof and a discharge outlet opening 154 therefrom to discharge the pressurized air from the housing along a prescribed pressurized air path $P_2$. The blower motor 155 is mounted on one side of the housing 151 to drive the blower impeller. The volumetric capacity of the blower 150 is selected to circulate the desired amount of air through the air passage 12 through the cabinet assembly 11 to meet the design criteria of the unit 10.

The blower 150 is mounted in the air passage downstream of the indoor coil 141 by an indoor blower mounting assembly 160. The blower mounting assembly 160 is constructed and arranged so that the blower 150 can be mounted in a first blower position $POS_1$ within the cabinet assembly 11 as seen in FIG. 15 where the blower 150 is located at the discharge opening 44 through the back panel 40 with the pressurized air path $P_2$ axially aligned with the central axis $A_1$ of the air supply duct flange 24 and a second blower position $POS_2$ within the cabinet assembly 11 seen in FIG. 16 where the blower is spaced away from the discharge opening 44 with the pressurized air path $P_2$ directed upwardly out of alignment with the central axis $A_1$ of the air supply duct flange 24. The first or ducted blower position $POS_1$ is used where the air discharged out of the unit 10 is ducted to the space being conditioned while the second or freeblow blower position $POS_2$ is used where the air is discharged out of the unit 10 directly into the space being conditioned.

The blower mounting assembly 160 includes a rectilinear blower mounting plate 161 defining a blower outlet opening 162 (FIG. 6) therethrough corresponding in size to the blower discharge opening 154. Blower support channels 164 (FIGS. 17–19) are mounted on opposite sides of the opening 162 and are connected to the blower housing 151 along opposite sides of the blower discharge opening 154 to mount the blower 150 on the mounting plate 161 with the pressurized air path $P_2$ extending out of the plate opening 162 generally normal to the surface of the mounting plate 161. A motor mount assembly 165 is provided to mount the blower motor 115 with the attached blower impeller 156 operatively located within the blower housing 151.

The front and back edges of the mounting plate 161 are provided with integral front and back sealing flanges 166 projecting from the plate 161 in the same direction as the blower 150 while opposite end edges of the plate 161 are provided with reinforcing flanges 168 projecting from the plate 161 oppositely of the blower 150.

Figure 17:
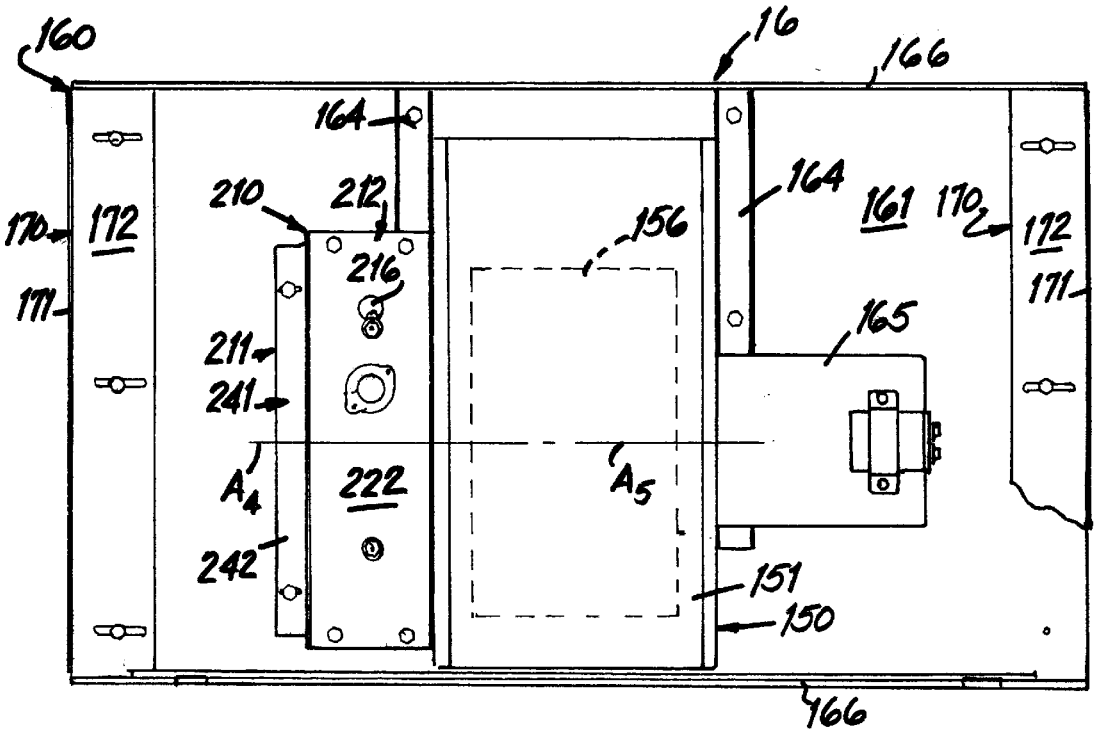
FIG. 17 is an enlarged front view of the indoor blower means, blower mounting means, heater means, and heater mounting means.

The mounting plate 161 is selectively mounted in the primary cabinet subassembly 20 with the blower 150 in position $POS_1$ or $POS_2$ by a pair of mounting angles 170 seen in FIGS. 16 and 17, each having a mounting leg 171 adapted to be attached to the side panel 70 while the other support leg 172 is adapted to be attached to the mounting plate 161 along the side edge thereof. The mounting leg 171 defines a set of pilot holes therethrough seen in FIG. 16 that align with a first set of mounting holes 174 in the side panel 70 just forward of the back edge thereof along a generally vertical path $P_3$ when the blower 150 is to be positioned in the first position $POS_1$ seen in FIG. 15 or with a second set of mounting holes 175 in the side panel 70 seen in FIG. 15 located along an almost horizontal path $P_4$ when the blower 50 is to be positioned in the second position $POS_2$ seen in FIG. 16. It will be noted that the path $P_4$ is spaced below the top panel 80 and that the pressurized air path $P_2$ is substantially horizontal in position $POS_1$ and rotated about 84° in position $POS_2$ so that the pressurized air being discharged from the blower outlet opening along path $P_2$ will impinge on the underside of the top panel assembly 34. It will also be noted that one of the mounting holes in the first set 174 is common to one of the mounting holes in the second set 175. Fasteners 176 (FIG. 2) are provided to threadedly engage the pilot holes in the mounting leg 171 and attach the indoor blower mounting assembly 160 to the side panels 70 through either the first set of holes 174 when the ducted position $POS_1$ is to be used or through the second set of holes 175 when the free blow position $POS_2$ is to be used.

The support leg 172 is slotted as seen in FIG. 17 so that the mounting angles 170 can be adjustably connected to the blower mounting plate 161 when the angles 170 are connected to the side panels 70 in order for the mounting angles/blower plate combination to extend completely across the full width of the air passage 12 to form an air seal with the side panel assemblies 30 and 31. The depth of the blower mounting plate is selected so that the front and back sealing flanges 166 seal against the insulation 41 on the front of the back panel 40 and the insulation 138 on the back of the front access panel 135 when the indoor blower mounting assembly 160 is in the second freeblow position $POS_2$.

When the indoor blower mounting assembly 160 is in the first ducted position $POS_1$ it will be seen that the surface of the blower mounting plate 161 is pressed against the insulation 41 on the front of the back panel 40 to form a seal therewith. In this position, the blower 150 discharges directly out of the air supply opening 45. On the other hand, when the indoor blower mounting assembly 160 is in the second freeblow position $POS_2$, the blower mounting plate 161 forms a pressurized air plenum 180 (FIG. 16) between the top panel assembly 34 and the plate 161 with the discharge from the blower 150 upwardly toward the top panel assembly 34. Thus, in position $POS_2$, air is forced out of the air supply opening 45 simply due to the higher pressure inside the plenum 180. This serves to attenuate the noise of the blower 150 being transmitted out of the air supply opening 45 when the unit 10 is in the freeblow application where the air is supplied directly into the conditioned space. When the air supply is ducted to the conditioned space, the fan noise is attenuated in the supply duct itself so that the fan can discharge directly out of the air supply opening 45 without raising the level of the noise transmitted to the conditioned space but overcoming the pressure loss in the supply duct so as to maintain the desired volumetric air flow to the conditioned space.

It will be appreciated that the cross-sectional size blower outlet opening 162 through the mounting plate 161 is much smaller than the cross-sectional size of the air supply opening 45 from the cabinet assembly as best seen in FIG. 3. This is because a larger opening is needed to reduce the pressure loss across the air supply opening 45 while still maintaining the volumetric air flow.

A control box assembly 181 seen in FIGS. 11, 15, and 22 is provided to house the electrical controls 182 for the refrigeration circuit 140, indoor air circulation blower means 16 and outdoor air circulation fan means 18. The control box assembly 181 includes an inverted L-shaped box member 184 having a width corresponding to the distance between the side panels 70. The box member 184 is positioned on top of the divider plate 84 adjacent the front of the unit so that the depending vertical leg 185 on the box member 184 seals against the insulation on top of the plate 112 and the horizontal leg 186 of the box member 184 projects forwardly of the leg 184. The front edge of the horizontal leg 186 is provided with an upstanding lip 187 to seal against the insulation 138 on back of the front access panel 135 as will become apparent. The leg 186 is spaced above the divider plate 112 a prescribed height $HT_1$ as seen in FIG. 15 and opposite ends of the box member 184 are sealed to the side panels 70 through the insulation 79 thereon to define an open front control space 188 subtended by the control box member 184, the end panels 70, and the divider plate 112 along the lower edge of the upper front opening in the primary cabinet assembly 20 which is sealed from the rest of the air passage 12 through the unit 10.

The open front of the control space 188 is selectively closed by a control box cover assembly 189 (FIGS. 15 and 23) that includes a cover member 190 that can be selectively mounted on or removed from the front of the control box member 184 when the front access panel assembly 36 is removed. A disconnect access opening 191 is defined through the cover member 190 adjacent one end thereof and is arranged so as to overlie the electrical disconnect assembly 192 of the electrical controls 182 mounted in the control box member 184.

The electrical disconnect assembly 192 is of conventional construction with one or more base elements 194 (FIGS. 15, 22, and 23) fixedly mounted on the vertical leg 185 on the control box member 184 in registration with opening 191. Each of the base elements is provided with a removable connecting element 195 that seats in the recess 197 in the base element 194 to connect the electrical controls 182 to a conventional outside power source to operate the unit.

The control box cover assembly 189 also includes a disconnect cover member 196 (FIGS. 15 and 23) mounted on the backside of the cover member 190 behind the opening 191 and projects a prescribed distance behind the cover member 190 so that the base section 198 of the cover member 196 overlies the forwardly facing end of the base element 194 when the cover 190 is in place on the control box member 184. A base access opening 199 is defined through the base section 198 with the same cross-sectional size and shape as the opening to the recess 197 in each base element 194 and is in registration with the base element recess when the cover 190 is in place.

Figure 23:
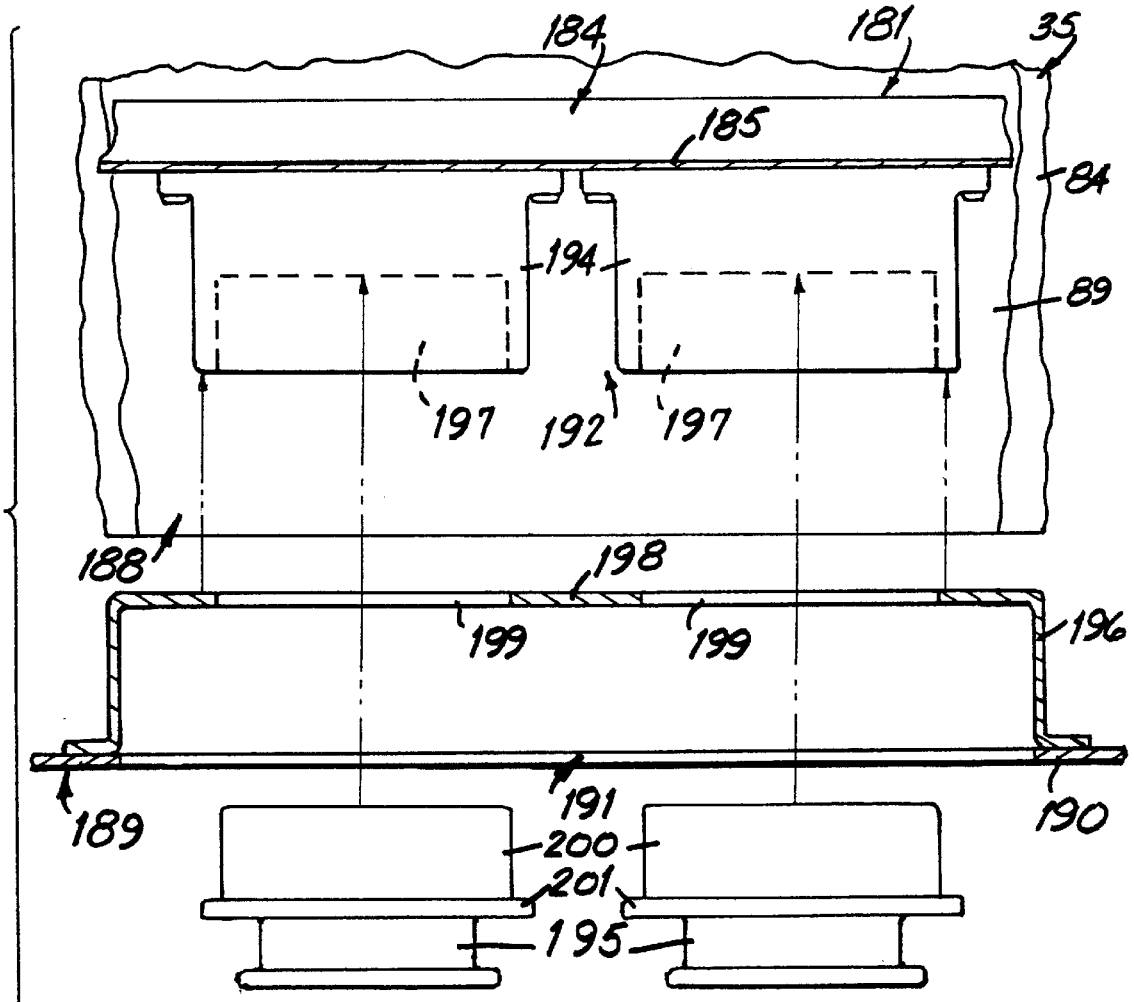
FIG. 23 is an enlarged exploded cross-sectional view taken generally along line 23—23 in FIG. 2 showing the interconnection with the quick disconnect means and control box cover.

The connecting element 195 seen in FIG. 23 includes an insertable body 200 with a cross-sectional size and shape complementary to the recess in the base element 194 that fits through the opening 199 into the recess in the base element 194 to connect the power source to the unit. A stop flange 201 is provided around the body 200 spaced a prescribed distance from the projecting end of the insertable body such that the flange abuts the base section 198 on the disconnect cover member 196 when the insertable body 200 on the connecting element 195 is fully seated in the recess in the base element 194. The flange 201 thus serves to prevent the control box cover member 190 from being removed from the front of the control box assembly 181 without the connecting element 195 being first removed from the base element 194 to disconnect the unit from the power source. The disconnect access opening 191 through the cover member 190 and the access recess formed in the disconnect cover member 196 are sized to allow the service personnel to manually reach through the opening 191 and remove the connecting element 195 prior to removal of the front access panel assembly 36. This reduces the likelihood of electrical short or shock during removal of the cover member 190 and insures that the service personnel will have to reinstall the connecting element 195 after the cover member 190 is removed to operate the unit during servicing. Likewise, if the connecting element 195 is installed during servicing, the disconnect cover member 196 also prevents the cover member 190 from fitting onto the front of the control box assembly 180 until the connecting element 195 is again removed. Access to the connecting elements 195 through the front access panel assembly 36 is provided by a small access door 202 in the front access panel 135 seen in FIG. 1.

In order to properly diagnose problems and service the unit 10, it is sometimes necessary to operate the unit under normal operating conditions. To do this, it is necessary to seal the open front of the primary cabinet assembly 20 above the divider plate 84 so that the indoor air passage 12 remains sealed. The unit 10 is designed so that the front access panel assembly 36 can be reattached to the front of the primary cabinet subassembly 20 while leaving the open front control space accessible to connect test equipment to the electrical controls and refrigeration circuit within the control box assembly 181.

As seen in FIG. 22, the front access panel 135 is provided with a base set of mounting holes 205 while the front inturned flanges 71 on the right and left side panel assemblies 31 and 32 are provided with a first set of pilot holes 206 registrable with the mounting holes 205 (FIG. 22) when the front access panel assembly 36 is in the position covering the front of the primary cabinet subassembly 20 and extending from the top of the outdoor air fan mounting panel 38 to the top panel assembly 34 so that the front panel fasteners 208 can be screwed into the holes 206 through the holes 205 to removably mount the front access panel assembly 36 on the front of the primary cabinet subassembly 20 for normal use of the unit.

A second set of pilot holes 209 seen in FIG. 1 is also provided in the front inturned flanges 71 on the side panels 31 and 32 which are also registrable with some of the mounting holes 205 in the front access panel assembly 36 but are displaced upwardly from the first set of pilot holes 205 by the height $HT_1$ of the control box assembly 181. Thus, when the unit 10 is being serviced, the service person removes the front access panel assembly 36, removes the control box cover assembly 189, and then reattachs the front access panel assembly 36 to the front of the primary cabinet assembly 20 using the second set of pilot holes 209 as illustrated in FIG. 22 so that the front of the unit is closed for it to operate normally but access to the open front control space 188 is available for testing and servicing the unit.

To provide additional heat for the air being supplied to the conditioned space, a heater assembly 210 is provided as seen in FIGS. 15–18. The heater assembly 210 is mounted adjacent that blower inlet opening 152 opposite the blower motor 155 by a heater mounting means 211. Thus, when the centrifugal blower 150 is positioned in positions $POS_1$ or $POS_2$, the heater assembly 210 remains operatively associated with the blower.

The heater assembly 210 includes an open frame 212 defining an air flow passage 214 therethrough with one or more conventional resistance heating elements 215 mounted on the frame 212 so as to locate the heating element 215 within the passage 214. The frame 212 also mounts the high temperature limit switch 216 thereon so that it projects into the air flow passage 214. The limit switch 216 is connected to the circuit to power the heating element 215 and opens when the temperature within the passage 214 exceeds the maximum permissible temperature for safe operation. The limit switch 216 needs to be located within that portion of the air flow passage 214 most likely to be at the highest temperature during the operation of the unit 10. Because heated air rises, the highest temperature position in the air flow passage 214 is thus at the uppermost portion of the passage. Therefore, the frame 212 of the heater assembly 210 needs to be oriented with respect to the blower 150 to position the switch 216 in the uppermost portion of the air flow passage 214 even though the blower 150 can be located at position $POS_1$ or $POS_2$.

The heater frame 212 has a near side 220 adapted to be located against the blower housing 151 and a distal side 221 opposite the near side 220. The heater frame 212 includes a first side member 222 with the temperature limit switch 216 located thereon adjacent one end thereof so that the limit switch 216 projects interiorly of the side member 222 into the air flow passage 214. Frame 212 also includes a second side member 224 attached to that end of the first side member 222 opposite the switch 216 and oriented normal thereto, a third side member 225 attached to that end of the second side member 224 opposite the first side member 222, and a fourth side member 226 attached between those ends of the first and third side members 224 and 225 opposite the second side member 224.

The heater mounting means 211 includes a first housing mounting flange 230 along the near side 220 of the first side member 222 and a first plate mounting flange 231 along the distal side 221 of the third side member 225 which are adapted to be used to mount the heater assembly 210 to the blower 150 when the blower 150 is in the first position $POS_1$. The heater mounting means 211 also includes a second housing mounting flange 232 along the near side 220 of the second side member 224 and a second plate mounting flange 234 along the distal side 221 of the fourth side member 225 which are adapted to be used to mount the heater assembly 210 to the blower 150 when the blower 150 is in the second position $POS_2$. The heater mounting means 211 also includes a first set of housing mounting holes 235 (FIG. 16) through the first housing mounting flange 230 with a prescribed spacing therebetween and a second set of housing mounting holes 236 (FIG. 15) through the second housing mounting flange 232 with the same hole spacing as the holes 235. A first set of plate mounting pilot holes 238 (FIG. 16) is provided through the first plate mounting flange 231 with a prescribed spacing therebetween and a second set of plate mounting pilot holes 239 (FIG. 15) is provided through the second plate mounting flange 234 with the same hole spacing as the holes 238.

The heater mounting means 211 includes a set of housing pilot holes 240 (FIG. 19) in the side of the blower housing 151 adapted to be selectively aligned with the first or second set of housing mounting holes 235 or 236 when the central axis $A_4$ of the air flow passage 214 in the heater assembly 210 is coaxial with the central axis $A_5$ of the air inlet opening 150 in the housing 151 as seen in FIGS. 15–17.

Figure 18:
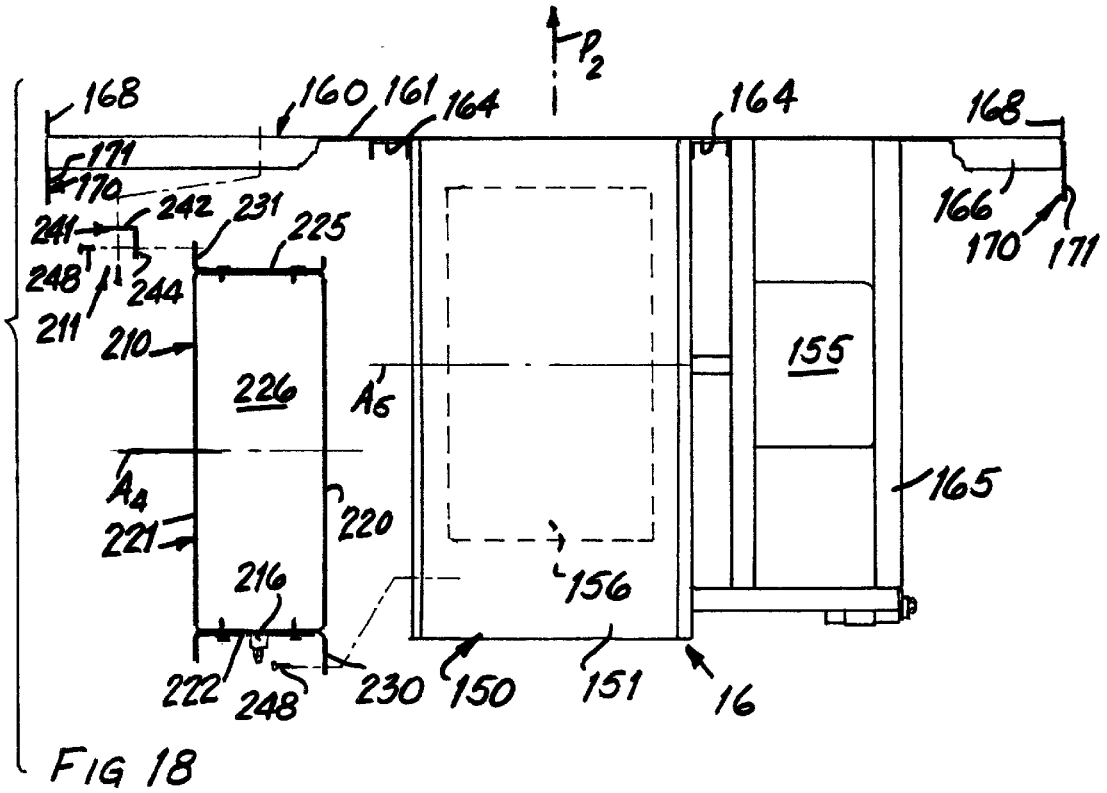
FIG. 18 is an exploded top view of the indoor blower means, blower mounting means, heater means, and heater mounting means as seen in FIG. 17.

To connect the heater assembly 210 to the blower mounting plate 161, the heater mounting means 211 further includes a heater mounting angle 241 seen in FIGS. 15, 17 and 18 with a base leg 242 adjustably attached to the mounting plate 161 and a mounting leg 244 normal to leg 242 projecting out from plate 161 parallel to the side of the blower housing 151. The mounting leg 244 defines a set of plate mounting holes therethrough with the same spacing as the first and second sets of plate mounting pilot holes 238 and 239 in the heater assembly 210. The heater mounting angle 241 is located so that the plate mounting holes in the mounting leg 244 will align with the first or second set of plate mounting pilot holes 238 or 239 when the central axis of the air flow passage 214 in the heater assembly 210 is coaxial with the central axis of the air inlet opening 150 in the housing 151. Moreover, the holes in the mounting leg 244 align with the first set of pilot holes 238 when the housing pilot holes 240 are aligned with the first set of mounting holes 235 in the heater frame 211 and the holes in the mounting leg 244 align with the second set of pilot holes 239 when the housing pilot holes 240 are aligned with the second set of mounting holes 235 in the heater frame 211.

When the blower 150 is positioned in the first ducted position $POS_1$ as seen in FIG. 15, the first set of blower mounting holes 235 are used to attach the frame 211 to the blower housing 151 through the pilot holes 240 using appropriate heater mounting fasteners 248 and the heater mounting holes in the heater mounting angle 241 are used to attach the heater frame 211 thereto through the first set of pilot holes 238 using fasteners 248. It will thus be seen that the high temperature limit switch 216 will be located in the uppermost portion of the heater air flow passage 214 when the blower 150 is located in the position $POS_1$.

When the blower 150 is positioned in the second freeblow position $POS_2$ as seen in FIG. 16, the second set of blower mounting holes 236 are used to attach the frame 211 to the blower housing 151 through the pilot holes 240 using appropriate heater mounting fasteners 248 and the heater mounting holes in the heater mounting angle 241 are used to attach the heater frame 211 thereto through the second set of pilot holes 239 using fasteners 248. It will thus be seen that the high temperature limit switch 216 will be located in the uppermost portion of the heater air flow passage 214 when the blower 150 is located in the position $POS_2$.

The outdoor air circulation fan means 18 best seen in FIGS. 6, 20, and 21 is mounted on the inside of the outdoor air fan mounting panel 38. The fan mounting panel 38 defines a louvered front outdoor air discharge opening 250 therethrough (FIGS. 1, 20, and 21) around a fan mounting section 251 in the center thereof. The discharge opening 250 comprises a plurality of radially extending slits formed around the fan mounting section 251 that are formed into louvers 254 with openings therebetween. A circular reinforcing bead 255 is formed in the fan mounting section 251 to reinforce it and a central draw opening 256 is provided through the center of the section 251 to allow for the metal forming operation on the panel 38 without metal wrinkling.

The fan means 18 comprises a outdoor air fan assembly 260 mounted on the back surface of the mounting section 251. The motor 261 of the fan assembly 260 is mounted directly to the section 251 and the fan blades 262 are mounted directly on the motor shaft so the they are located behind the louvered discharge opening 250 and adapted to force air forwardly out of the opening 250 from within the outdoor air passage 14. To enhance the efficiency of the fan assembly 260, a venturi ring 264 is provided that extends around the tips of the fan blades 262 to form a venturi about the blades. The venturi ring 264 is a seamless member and is attached directly on the mounting panel 38 just outboard of the louvered opening 250 and serves to strengthen the panel 38. The venturi ring 262 is spin formed from a seamless ring of material to minimize the amount of scrap metal produced in the ring forming operation. It will likewise be seen that this construction makes the fan assembly 260, compressor 144, and outdoor coil 142 easily accessible for service simply by removing the outdoor fan mounting panel 38.

For ease of manufacturing, the front access panel assembly 36 and outdoor air fan mounting panel 38 are installed after all of the refrigeration and electrical assembly is completed for the primary cabinet subassembly 20. Because the primary cabinet subassembly 36 is self supporting, the front and back of the subassembly 36 is left open for assembly access. The outdoor fan assembly 260 and venturi ring 264 can be preassembled on the outdoor air fan mounting panel 38 before the panel 38 is installed to further facilitate the assembly of the unit 10. Likewise, the back panel subassembly 21 can be fabricated separately from the primary cabinet subassembly 20 to further facilitate the assembly of the unit. As a result manufacturing cost is reduced over the prior art assembly techniques.

To install the unit 10, the back panel subassembly 21 is separated from the primary cabinet subassembly 20 and installed directly on the wall EW using the fasteners 25. Because the subassembly 21 is lightweight, it is easily supported during placement on the wall EW and access is provided so that the alignment of the duct flanges 22 and 24 with the air supply and return passages ASP and ARP can be assured. The heavier primary cabinet subassembly 20 is then supported on appropriate equipment and moved over to the back panel subassembly 21 where it is tilted back slightly (usually about 5°) so that the hook member 92 on the primary cabinet subassembly 20 will engage the hook member 94 on top of the back panel subassembly 21 in the initial tilted position ITP. As the primary cabinet subassembly 20 is lowered, the hook members 92 and 94 will engage and the primary cabinet subassembly 20 will be supported on the back panel subassembly 21. As the equipment supporting the primary cabinet subassembly 20 continues to remove support therefrom, the weight of the primary cabinet subassembly 20 will force the primary cabinet subassembly toward the final seated position FSP. To fully seat the primary cabinet subassembly 20 on the back panel subassembly 21, the installer simply pushes back on the primary cabinet subassembly 20 so that the hook member 92 slides back along the hook member 94 until the final seated position FSP is reached. The installer then installs the fasteners 265 of the cabinet connection means 28 to complete the installation. It will be appreciated that a seal between the wall EW and the periphery of the primary cabinet subassembly 20 is made with an appropriate sealant. The sealant can be preapplied to the side sealing flanges 72 on the side panel assemblies 31 and 32 so that the seal is formed as an incident to the installation.

In the event the unit 10 becomes inoperable and needs to be replaced, it is only necessary that the primary cabinet subassembly 20 be removed and replaced. This is because all of the operating components of the unit 10 are mounted in the subassembly 20.

It will likewise be appreciated that the prepositioning means 26 is illustrated being located at the top of the primary cabinet subassembly 20 and the back panel subassembly 21, however, the prepositioning means may be located at different positions on the subassemblies 20 and 21 without departing from the scope of the invention. For instance, the prepositioning means 26 may be configured to interconnect the bottoms of the subassemblies 20 and 21 so that the primary cabinet subassembly 20 may be tilted away from the back panel subassembly 21 at the top, the primary cabinet subassembly 20 supported on the back panel subassembly 21, and then the top of the primary cabinet subassembly pushed back to seat the primary cabinet subassembly 20 on the back panel subassembly 21.

What is claimed as invention is:

1. A single package HVAC unit comprising:

A) a cabinet assembly;

B) a refrigeration circuit housed in said cabinet assembly;

C) an open front control box mounted in said cabinet assembly;

D) electrical controls for controlling the operation of said refrigeration circuit housed in said control box, said electrical controls comprising electrical disconnect means for connecting the electrical controls to an electrical power source, said electrical disconnect means including a base element fixedly mounted in said control box and a connecting element removably insertable into said base element to connect said electrical controls to the power source when said connecting element is inserted into said base element and for disconnecting said electrical controls for the power source when said connecting element is removed from said base element;

E) a control box cover removably covering the open front of said control box; and, F) interconnect means on said control box cover operatively associated with said disconnect means so as to prevent removal of said control box cover from said control box without removal of said connecting element from said base element of said disconnect means.

2. The single package HVAC unit of claim 1 wherein said connecting element of said disconnect means includes an insertable body sized to fit in said base element and an outwardly projecting flange on said insertable body larger than said insertable body; and said interconnect means comprises a disconnect cover member fixedly mounted on said control box cover, said disconnect cover member constructed and arranged to overlie said base element when said control box cover is covering said control box and defining an opening therethrough sized to allow said insertable body to pass therethrough but to prevent said outwardly projecting flange from passing therethrough whereby said connecting element can be installed in said base element after said control box cover is covering said control box to connect said electrical controls to the power source while said disconnect cover member prevents said control box cover from being removed from said control box without removal of said connecting element.

* * * * *